US008914949B2

(12) United States Patent
Thomson et al.

(10) Patent No.: US 8,914,949 B2
(45) Date of Patent: Dec. 23, 2014

(54) MONEY HOLDING DEVICES

(76) Inventors: Chip Edward Thomson, Austin, TX (US); Chan Chun Yau, Hong Kong (CN); Timothy Uys, Leander, TX (US)

( * ) Notice: Subject to any disclaimer, the term of this patent is extended or adjusted under 35 U.S.C. 154(b) by 194 days.

(21) Appl. No.: 13/385,615

(22) Filed: Apr. 15, 2012

(65) Prior Publication Data

US 2014/0013551 A1 Jan. 16, 2014

(51) Int. Cl.
*A45C 1/06* (2006.01)

(52) U.S. Cl.
CPC ..... *A45C 1/06* (2013.01); *A45C 2001/062* (2013.01); *A45C 2001/065* (2013.01)
USPC ..... 24/67.9; 24/563

(58) Field of Classification Search
CPC ..... A45C 2001/062; A45C 2001/065; A45C 1/06
USPC ..... 24/499, 489, 455, 557, 67.9, 67.3
See application file for complete search history.

(56) References Cited

U.S. PATENT DOCUMENTS

| | | | | | |
|---|---|---|---|---|---|
| 1,139,627 | A | | 5/1915 | Baltzley | 24/565 |
| 1,150,073 | A | | 8/1915 | Spengler | 24/565 |
| 1,621,008 | A | * | 3/1927 | Fricker | 24/563 |
| 1,675,286 | A | * | 6/1928 | Van Valkenburg | 24/555 |
| 1,823,317 | A | * | 9/1931 | Cook | 24/561 |
| 2,478,376 | A | * | 8/1949 | De Swart | 24/67.9 |
| 3,027,995 | A | * | 4/1962 | Littman | 206/0.81 |
| 4,675,953 | A | | 6/1987 | Higgs | 24/499 |
| 4,903,376 | A | * | 2/1990 | Rousseau | 24/67.9 |
| D321,210 | S | | 10/1991 | Hiromori | D19/65 |
| 5,249,437 | A | | 10/1993 | Cole | 63/1.12 |
| 5,520,230 | A | * | 5/1996 | Sumner, III | 150/147 |
| D372,498 | S | | 8/1996 | Sato | D19/65 |
| 5,606,777 | A | * | 3/1997 | Lu | 24/67.9 |
| 5,697,131 | A | * | 12/1997 | Hunt et al. | 24/563 |
| 5,970,777 | A | * | 10/1999 | Hunt et al. | 72/379.2 |
| 6,082,422 | A | * | 7/2000 | Kaminski | 150/147 |
| D437,613 | S | * | 2/2001 | Melnyk | D19/34 |
| 6,327,749 | B1 | | 12/2001 | Antinone | 24/67 R |
| D461,427 | S | * | 8/2002 | Braner | D11/78.1 |
| 6,457,218 | B1 | * | 10/2002 | Lawrence | 24/563 |
| D492,351 | S | * | 6/2004 | Sato et al. | D19/65 |
| 6,745,805 | B2 | | 6/2004 | Thomson | 150/137 |
| D496,397 | S | * | 9/2004 | Melnyk | D19/34 |
| 6,851,147 | B2 | | 2/2005 | Abrahall | 7/151 |
| 6,988,296 | B1 | * | 1/2006 | McGarity et al. | 24/67.3 |

(Continued)

FOREIGN PATENT DOCUMENTS

| | | |
|---|---|---|
| CA | 2561522 | 2/2006 |
| DE | 602004032985 | 8/2011 |

(Continued)

OTHER PUBLICATIONS

U.S. Appl. No. 60/458,492, filed Mar. 28, 2003, Thomson et al.

(Continued)

*Primary Examiner* — Robert J Sandy
*Assistant Examiner* — David Upchurch
(74) *Attorney, Agent, or Firm* — Fulbright & Jaworski LLP

(57) ABSTRACT

Money holding devices (e.g., clips) configured to move from a closed configuration to an open configuration by applying a force to a portion of one arm of the clip that is wider than a corresponding portion of another arm of the clip.

20 Claims, 24 Drawing Sheets

(56) References Cited

U.S. PATENT DOCUMENTS

| | | | | |
|---|---|---|---|---|
| 7,120,970 | B2 | 10/2006 | Thomson et al. | 24/67.5 |
| D557,089 | S * | 12/2007 | Menard et al. | D8/34 |
| D581,311 | S * | 11/2008 | Cornett | D11/78.1 |
| 7,536,753 | B2 | 5/2009 | Thomson et al. | 24/67.5 |
| 7,770,263 | B2 | 8/2010 | Thomson et al. | 24/67.7 |
| D634,363 | S * | 3/2011 | Robbins | D19/34 |
| D636,293 | S * | 4/2011 | Dolce et al. | D11/222 |
| 7,921,527 | B2 * | 4/2011 | Moy | 24/462 |
| 2002/0157745 | A1 | 10/2002 | Stodghill | 150/137 |
| 2006/0076094 | A1 * | 4/2006 | Kaminski | 150/147 |
| 2008/0178976 | A1 | 7/2008 | Lakhiani | 150/137 |
| 2009/0229084 | A1 | 9/2009 | Thomson et al. | 24/67.5 |
| 2010/0078101 | A1 * | 4/2010 | Styron et al. | 150/137 |
| 2011/0047758 | A1 | 3/2011 | Thomson et al. | 24/67.7 |

FOREIGN PATENT DOCUMENTS

| | | |
|---|---|---|
| EP | 1653824 | 5/2006 |
| EP | 2404522 | 1/2012 |
| FR | 1653824 | 6/2011 |
| GB | 1653824 | 6/2011 |
| HK | 1092658 | 11/2006 |
| HK | 1165236 | 10/2012 |
| MX | 284029 | 2/2011 |
| WO | WO 2006/014149 | 2/2006 |
| WO | WO 2006/055958 | 5/2006 |

OTHER PUBLICATIONS

U.S. Appl. No. 60/629,280, filed Nov. 18, 2004, Thomson et al.

U.S. Appl. No. 12/853,907, filed Aug. 10, 2010, Thomson et al.

U.S. Appl. No. 10/060,942, filed Jan. 30, 2002, Thomson.

U.S. Appl. No. 10/813,640, filed Mar. 29, 2004, Thomson et al.

U.S. Appl. No. 11/550,353, filed Oct. 17, 2006, Thomson et al.

U.S. Appl. No. 11/283,403, filed Nov. 18, 2005, Thomson et al.

International Search Report and Written Opinion issued in PCT Application No. PCT/US2013/036541, mailed Jul. 30, 2013.

* cited by examiner

MONEY HOLDING DEVICES

BACKGROUND

1. Field of the Invention

The present invention relates generally to money holding devices (e.g., clips), and more particularly, but not by way of limitation, to money holding devices configured to move from a closed configuration to an open configuration by applying a force.

2. Description of Related Art

Devices that hold money, whether in the form of paper currency or credit cards, come in a variety of shapes and sizes. Examples of such devices, sometimes referred to as money clips, are found in U.S. Pat. Nos. 7,536,753, 6,327,749, 5,249,437, and 4,675,953. Devices known as binder clips, which are typically used in an office setting for keeping documents together in the absence of a staple, have been used as money clips. This is true of both binder clips without ornamentation of any kind, such as those depicted in U.S. Pat. Nos. 1,150,073 and 1,139,627, and with ornamentation as shown in U.S. Pat. No. 6,327,749. Other binder clips are disclosed in U.S. Pat. Nos. D372,498 and D321,210.

SUMMARY

This disclosure includes embodiments of money holding devices configured, for example, to move from a closed configuration to an open configuration by applying a force.

Some embodiments of the present devices comprise two arms, examples of which are referred to as first and second members below, that are coupled through a connector (e.g., a resilient connector that helps to bias the arms into a closed position), and one arm is shorter than the other. The end of the shorter arm is either flush with the longer arm or is angled into, as opposed to certain prior art money clips in which the end of one arm is angled away from the other arm. The present embodiments may be characterized as one-piece money clips or one-piece money holding devices, and some embodiments of them are configured so that when they are holding one or more of a wallet, paper, and cards, the arms can be flush against the held content (the material being held), and may be in that position and parallel with each other over some or all of the respective lengths.

Some embodiments of the present money holding devices comprise a first member having a first end, a second end, and at least one width; a second member having: a first end extending beyond the first end of the first member; a second end; and a portion having at least one width that is less than the at least one width of the first member; and a connector (e.g., a resilient connector) coupling the second end of the first member to the second end of the second member, the connector configured to bias at least one of the first and second members toward the other of the first and second members to define a closed configuration; where the device can be moved into an open configuration by applying a force to the first member at a position corresponding to the portion of the second member having at least one width that is less than the at least one width of the first member.

Some embodiments of the present money holding devices comprise a first member having a first end, a second end, and at least one width; a second member having: a first end extending beyond the first end of the first member; a second end; and a portion having at least one width that is greater than the at least one width of the first member; and a connector coupling the second end of the first member to the second end of the second member, the connector configured to bias at least one of the first and second members toward the other of the first and second members to define a closed configuration; where the device can be moved into an open configuration by applying a force to the first member at a position corresponding to the portion of the second member having at least one width that is less than the at least one width of the first member.

Some embodiments of the present money holding devices comprise a first member having: a first end; a second end; a first width; and a second width that is greater than the first width; a second member having: a first end extending beyond the first end of the first member; a second end; and a portion having at least one width that is less than the first width of the first member; and a connector coupling the second end of the first member to the second end of the second member, the connector configured to bias at least one of the first and second members toward the other of the first and second members to define a closed configuration; where the device can be moved into an open configuration by applying a force to the first member at at least one of the second width of the first member and a position corresponding to the portion of the second member with a width of less than the first width of the first member.

Any embodiment of the present money holding devices may be packaged with a wallet and placed in a box, forming a kit. The kit may also include instructions for use, describing how to grasp the device and where to apply force to open it.

Any embodiment of any of the present devices can consist of or consist essentially of—rather than comprise/include/contain/have—any of the described elements and/or features. Thus, in any of the claims, the term "consisting of" or "consisting essentially of" can be substituted for any of the open-ended linking verbs recited above, in order to change the scope of a given claim from what it would otherwise be using the open-ended linking verb.

Details associated with the embodiments described above and others are presented below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures illustrate the described elements using graphical symbols that will be understood by those of ordinary skill in the art. The embodiments of the present money holding devices and their components shown in the figures are drawn to scale for at least the embodiments shown.

DESCRIPTION OF ILLUSTRATIVE EMBODIMENTS

The term "coupled" is defined as connected, although not necessarily directly, and not necessarily mechanically. The terms "a" and "an" are defined as one or more unless this disclosure explicitly requires otherwise. The term "substantially" (as well as the terms "approximately" and "about") is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a device that "comprises," "has," "includes," or "contains" one or more elements or features possesses those one or more elements or features, but is not limited to possessing only those elements or features. Likewise, a method that "comprises," "has," "includes," or "contains" one or more steps possesses those one or more steps, but is not limited to possessing only those one or more steps. Additionally, terms such as "first" and "second" are used only to differentiate structures or features, and not to limit the different structures or features to a particular order.

Further, a device or element or structure configured in a certain way is configured in at least that way, but can also be configured in other ways than those specifically described.

The feature or features of one embodiment may be applied to other embodiments, even though not described or illustrated, unless expressly prohibited by this disclosure or the nature of the embodiments.

Figure 1A:
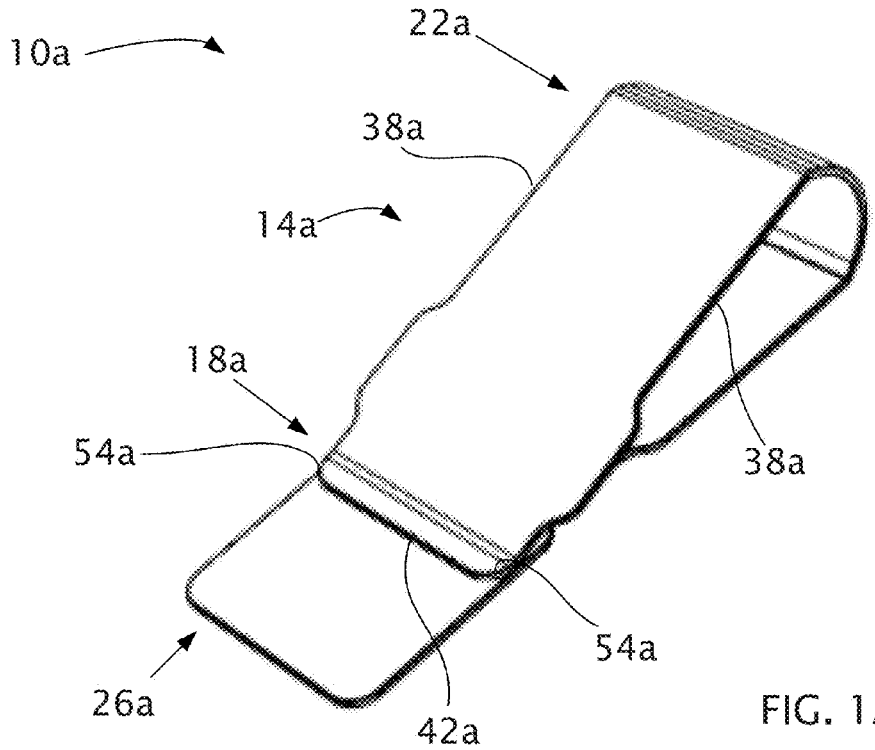
FIG. 1A depicts a top perspective view of one embodiment of the present money holding devices in a closed configuration.
Figure 1B:
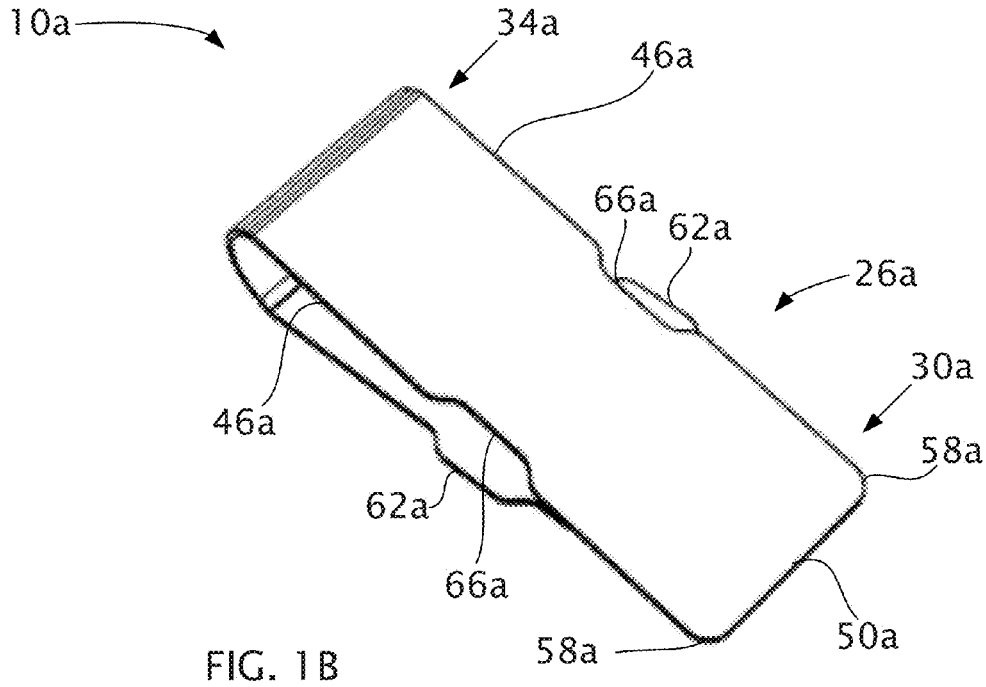
FIG. 1B depicts a bottom perspective view of the money holding device depicted in FIG. 1A.
Figure 1D:
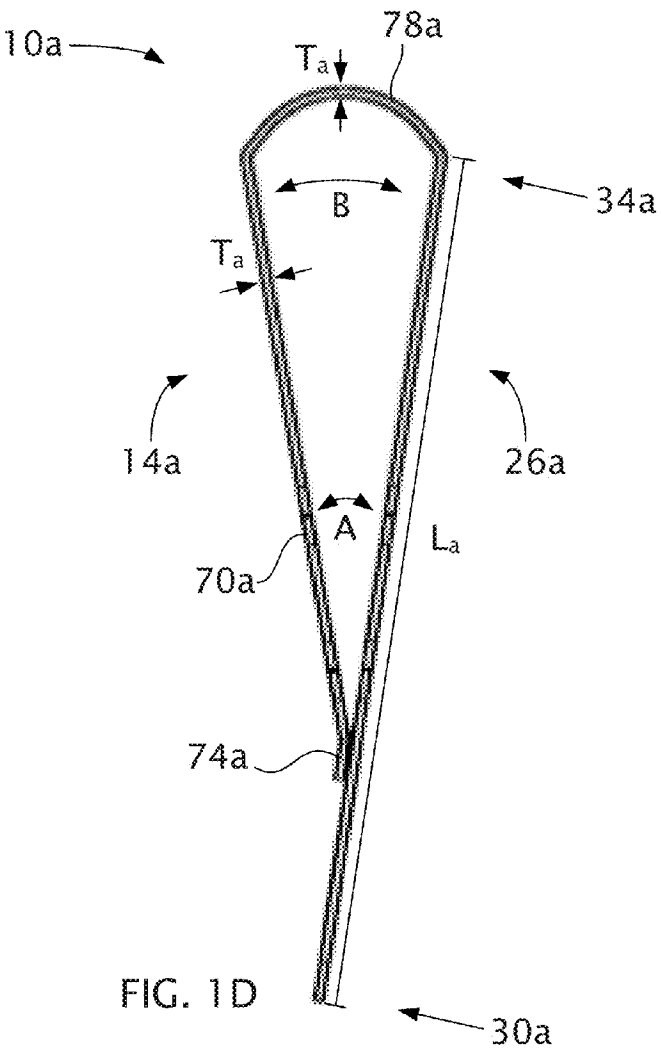
FIG. 1C-1D depict side views of the money holding device depicted in FIG. 1A.
Figure 1C:
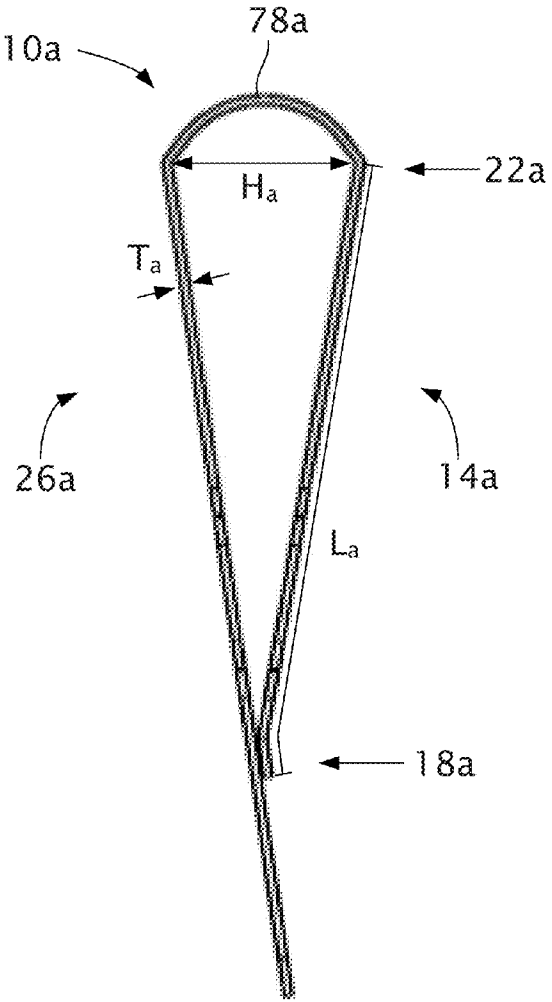
Figure 1F:
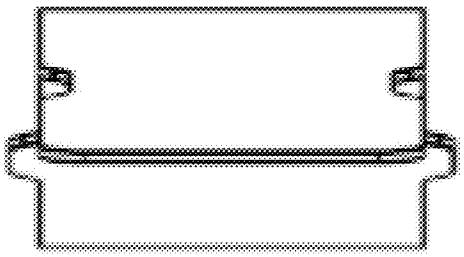
FIG. 1F depicts an upside down front view of the money holding device depicted in FIG. 1A.
Figure 1G:
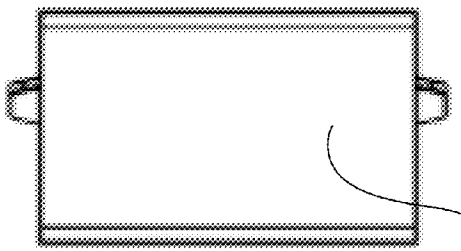
FIG. 1G depicts a back view of the money holding device depicted in FIG. 1A.
Figure 1E:
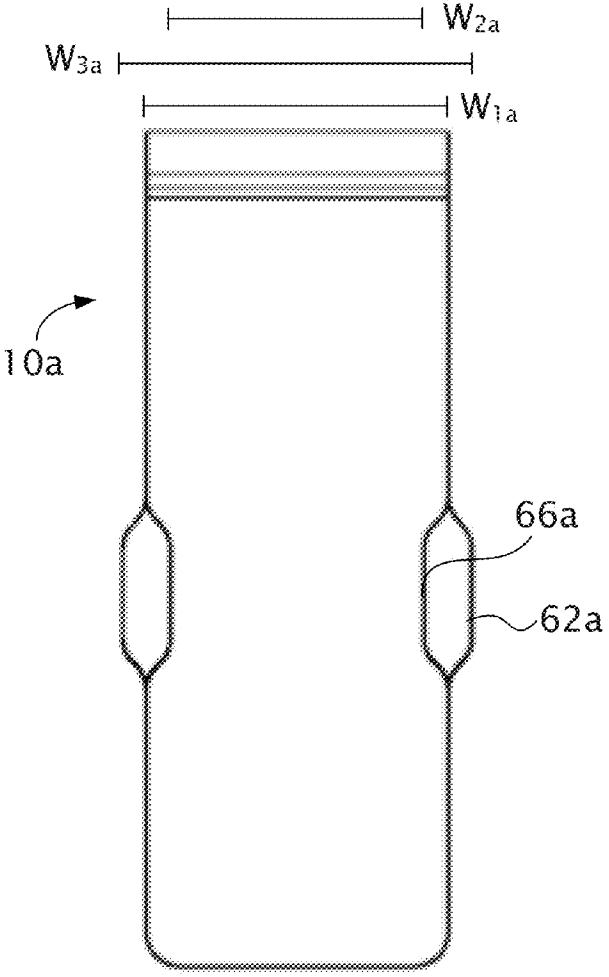
FIG. 1E depicts a bottom view of the money holding device depicted in FIG. 1A.
Figure 1H:
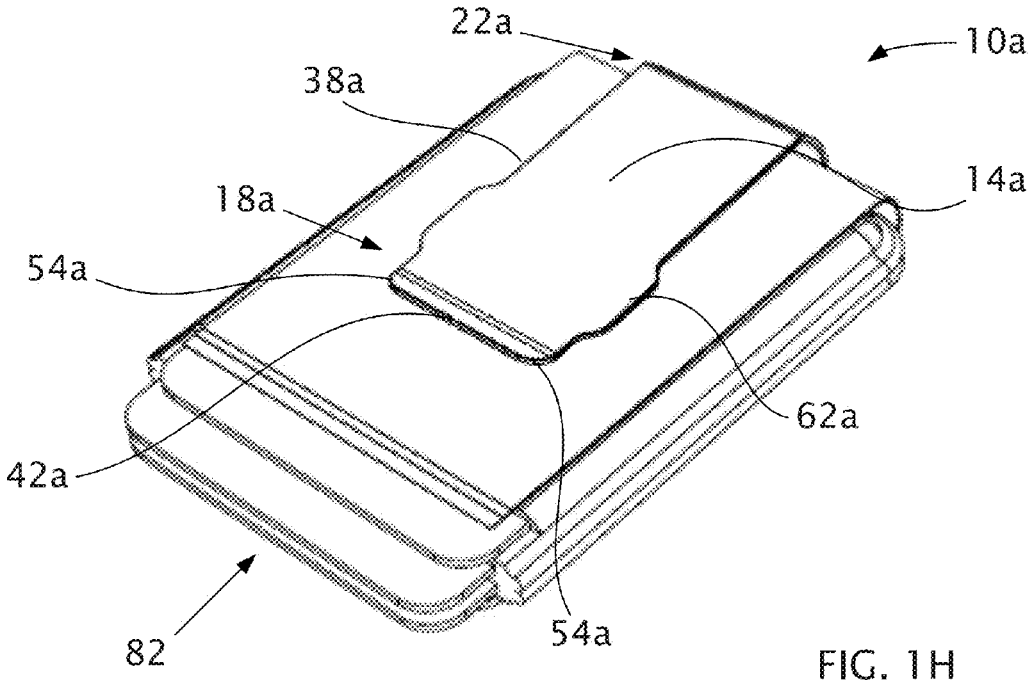
FIG. 1H depicts a top perspective view of the money holding device depicted in FIG. 1A in an open configuration and coupled to a wallet.
Figure 1I:
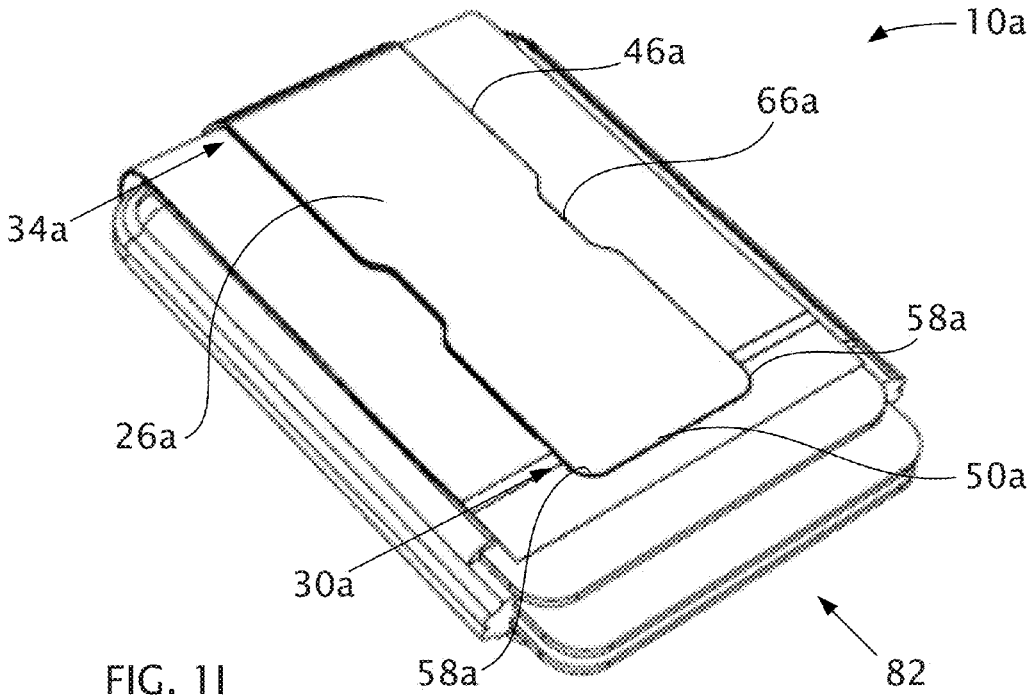
FIG. 1I depicts a bottom perspective view of the money holding device depicted in FIG. 1A in an open configuration and coupled to a wallet.
Figure 2A:
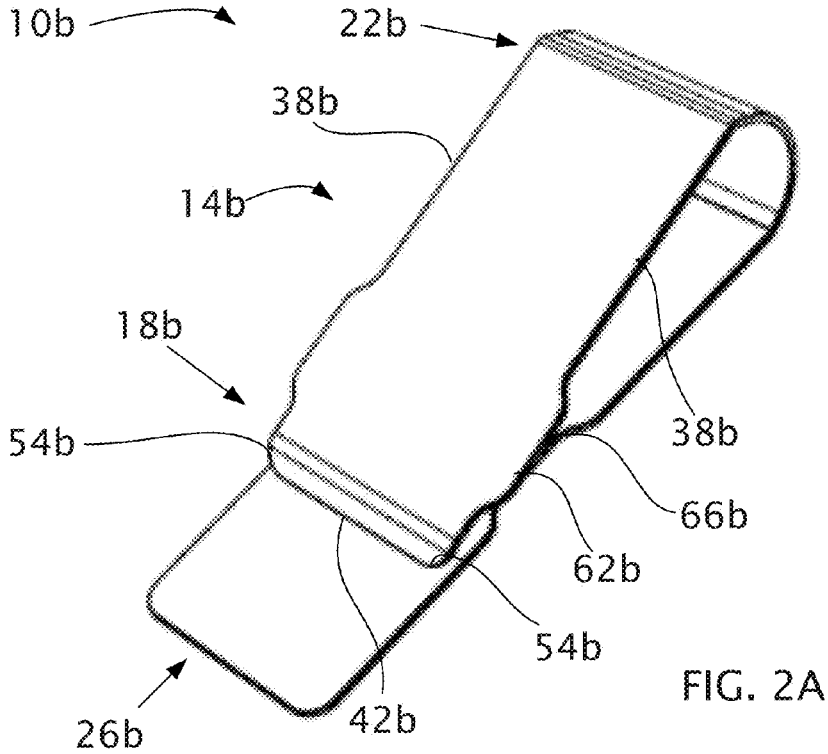
FIG. 2A depicts a top perspective view of another embodiment of the present money holding devices in a closed configuration.
Figure 2B:
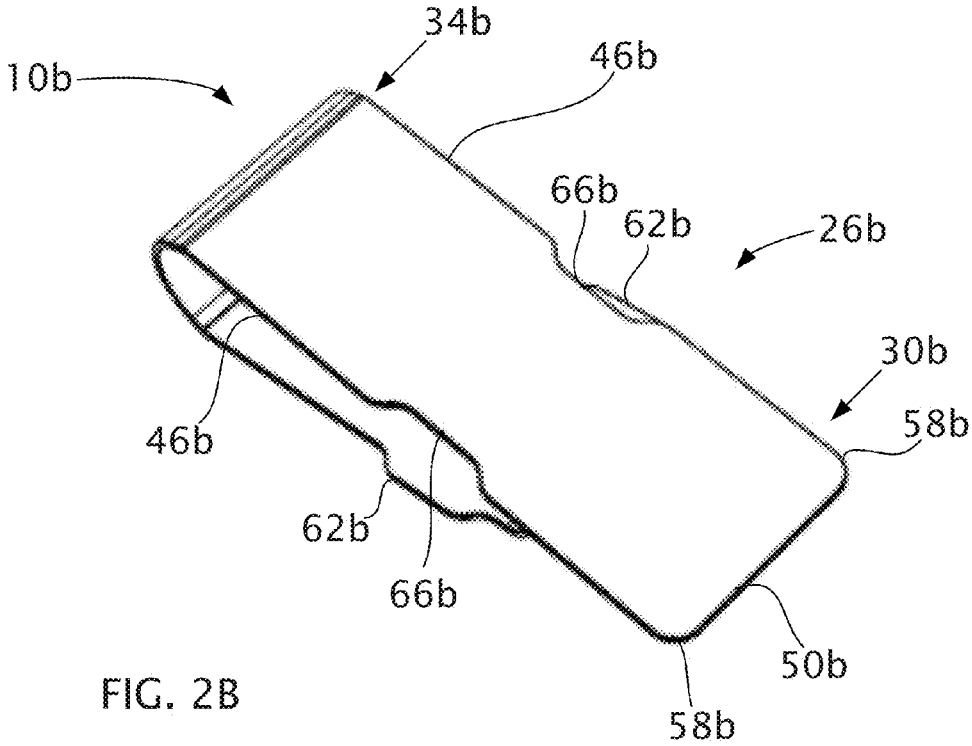
FIG. 2B depicts a bottom perspective view of the money holding device depicted in FIG. 2A.
Figure 2D:
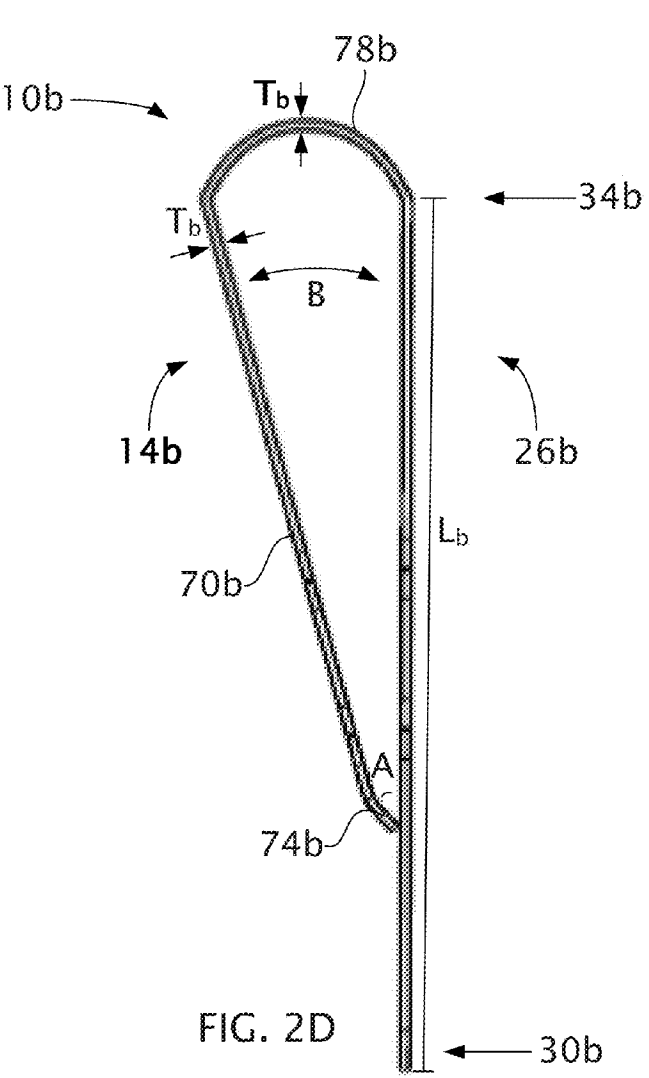
FIG. 2C-2D depict side views of the money holding device depicted in FIG. 2A.
Figure 2C:
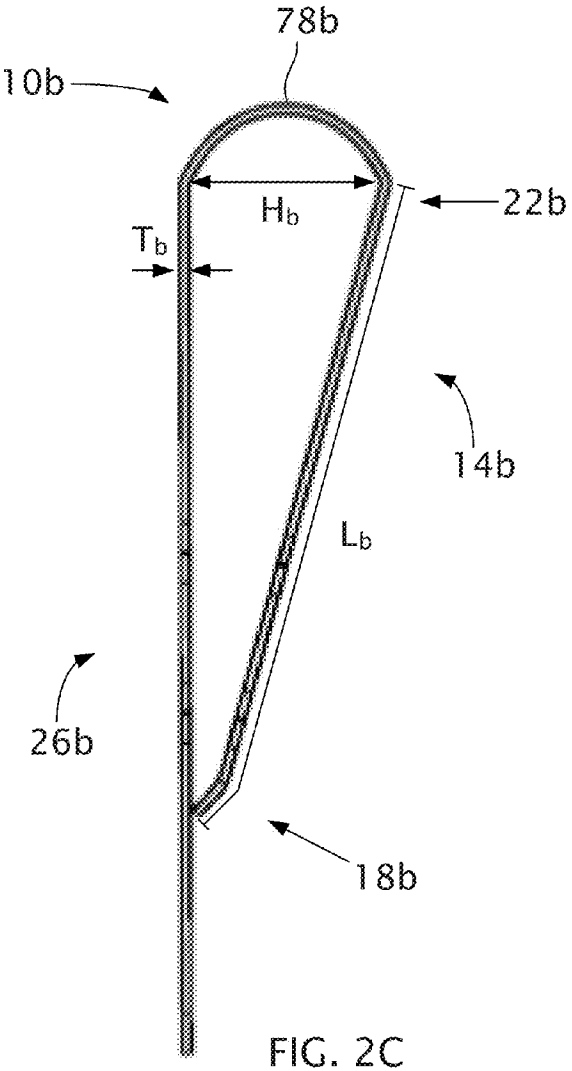
Figure 2F:
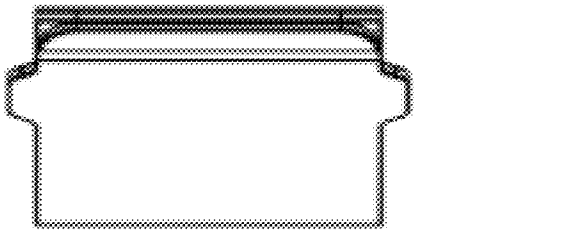
FIG. 2F depicts an upside down front view of the money holding device depicted in FIG. 2A.
Figure 2G:
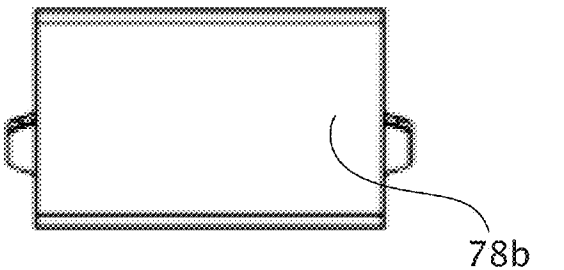
FIG. 2G depicts a back view of the money holding device depicted in FIG. 2A.
Figure 2E:
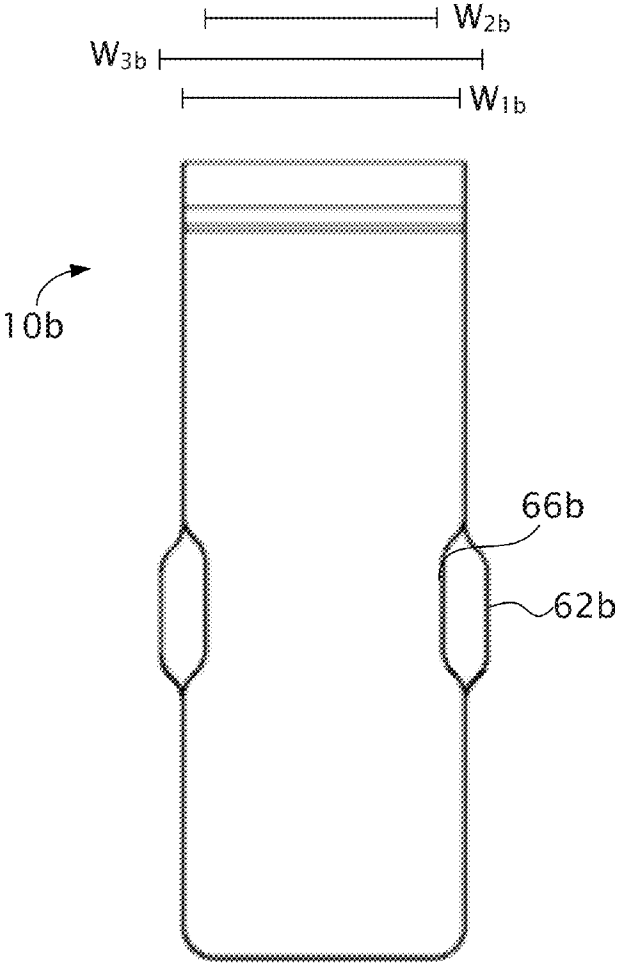
FIG. 2E depicts a bottom view of the money holding device depicted in FIG. 2A.
Figure 3A:
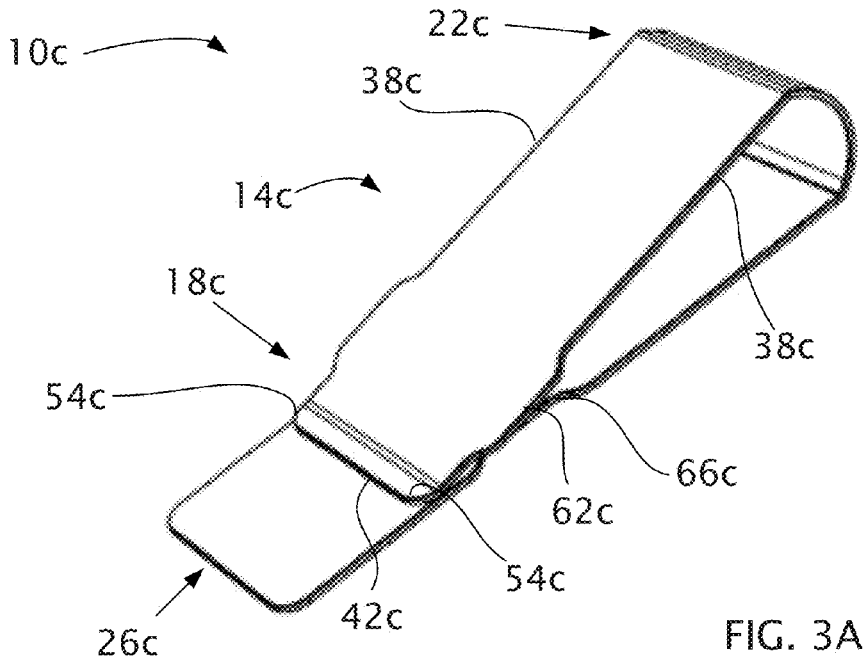
FIG. 3A depicts a top perspective view of another embodiment of the present money holding devices in a closed configuration.
Figure 3B:
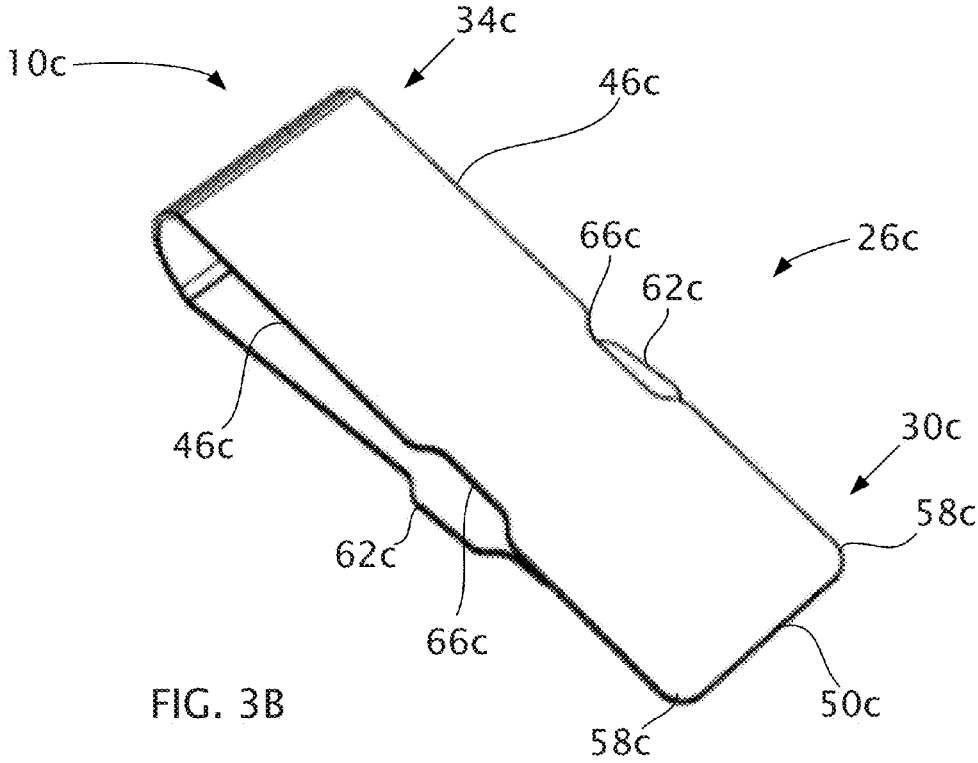
FIG. 3B depicts a bottom perspective view of the money holding device depicted in FIG. 3A.
Figure 3D:
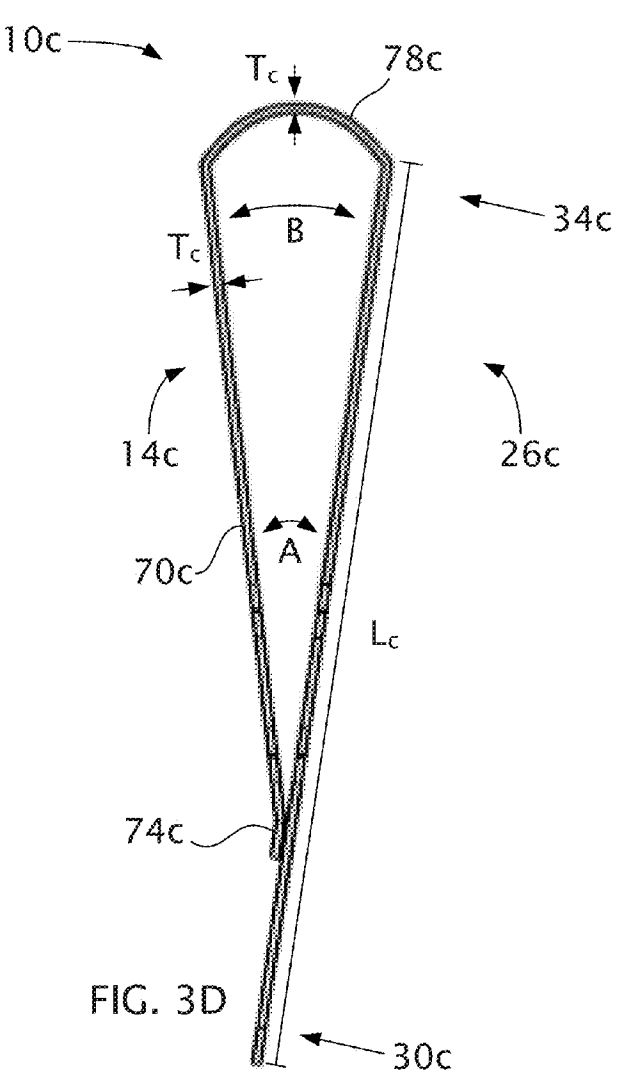
FIG. 3C-3D depict side views of the money holding device depicted in FIG. 3A.
Figure 3C:
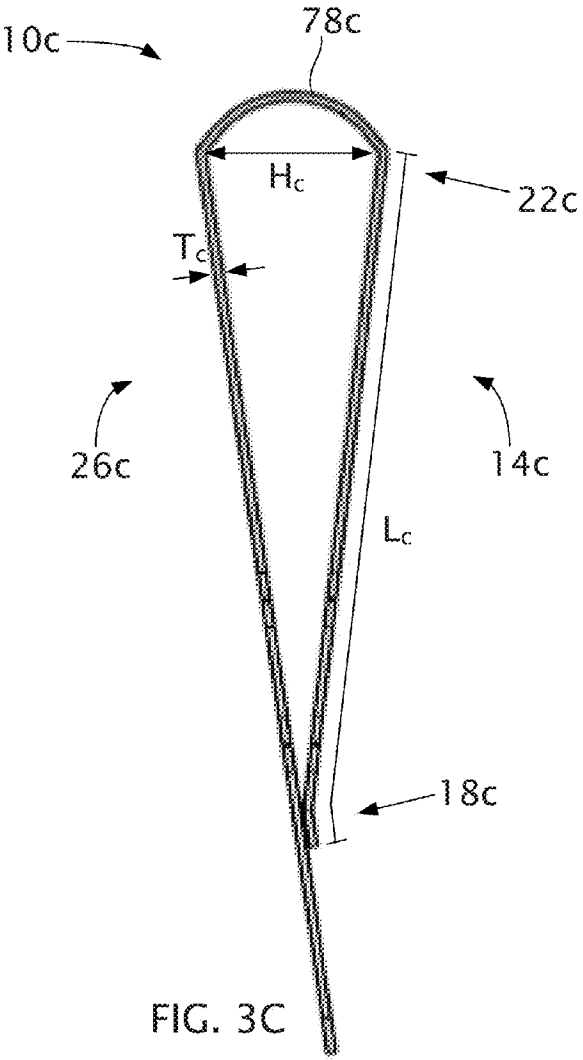
Figure 3F:
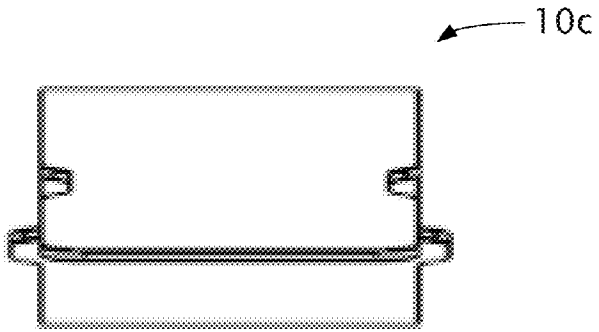
FIG. 3F depicts an upside down front view of the money holding device depicted in FIG. 3A.
Figure 3G:
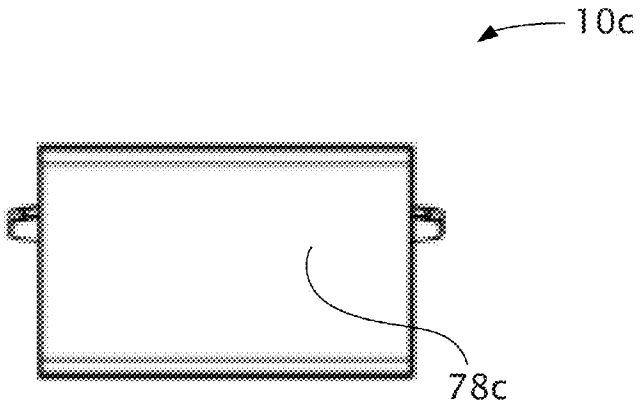
FIG. 3G depicts a back view of the money holding device depicted in FIG. 3A.
Figure 3E:
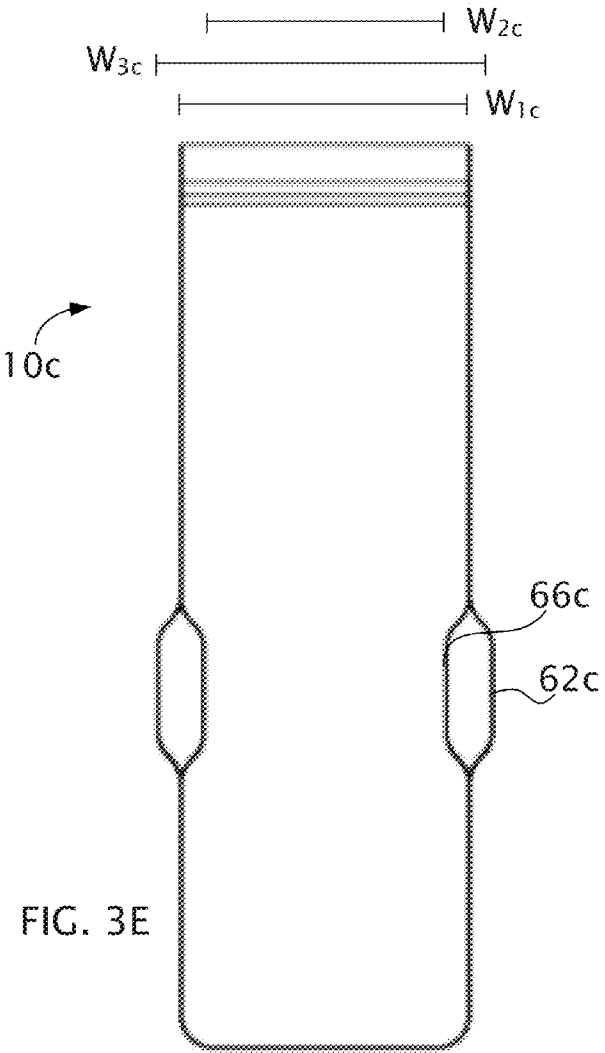
FIG. 3E depicts a bottom view of the money holding device depicted in FIG. 3A.
Figure 3H:
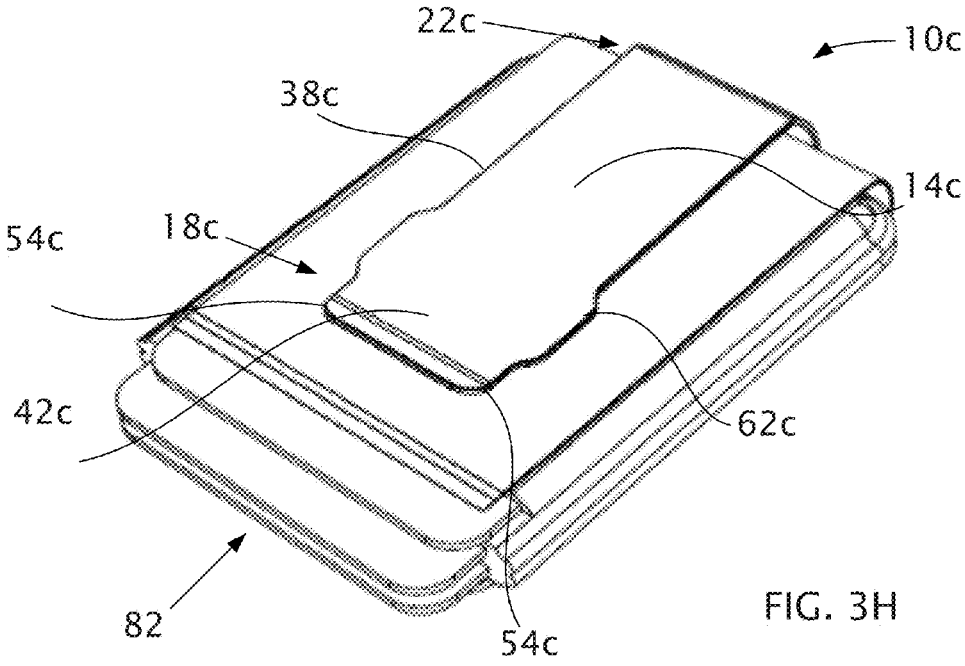
FIG. 3H depicts a top perspective view of the money holding device depicted in FIG. 3A in an open configuration and coupled to a wallet.
Figure 3I:
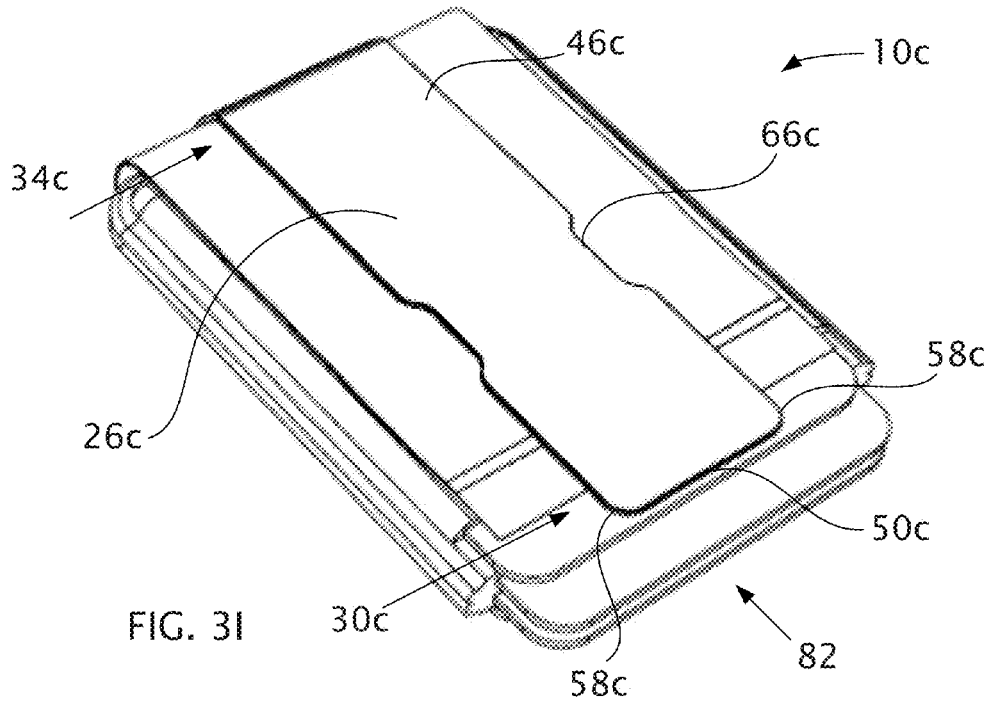
FIG. 3I depicts a bottom perspective view of the money holding device depicted in FIG. 3A in an open configuration and coupled to a wallet.
Figure 4A:
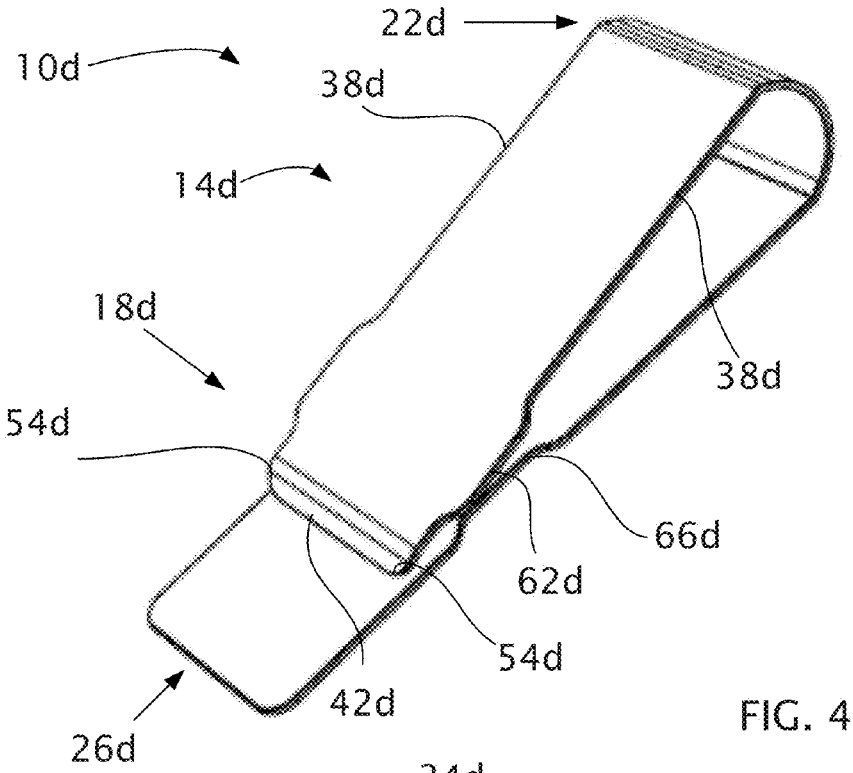
FIG. 4A depicts a top perspective view of another embodiment of the present money holding devices in a closed configuration.
Figure 4B:
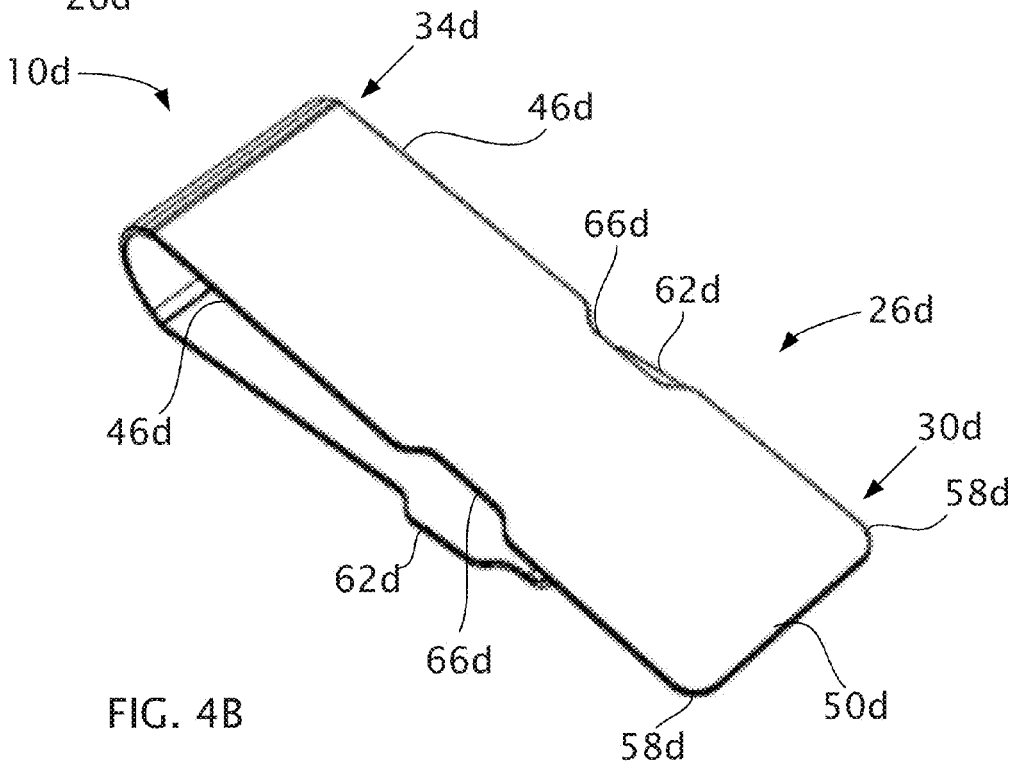
FIG. 4B depicts a bottom perspective view of the money holding device depicted in FIG. 4A.
Figure 4D:
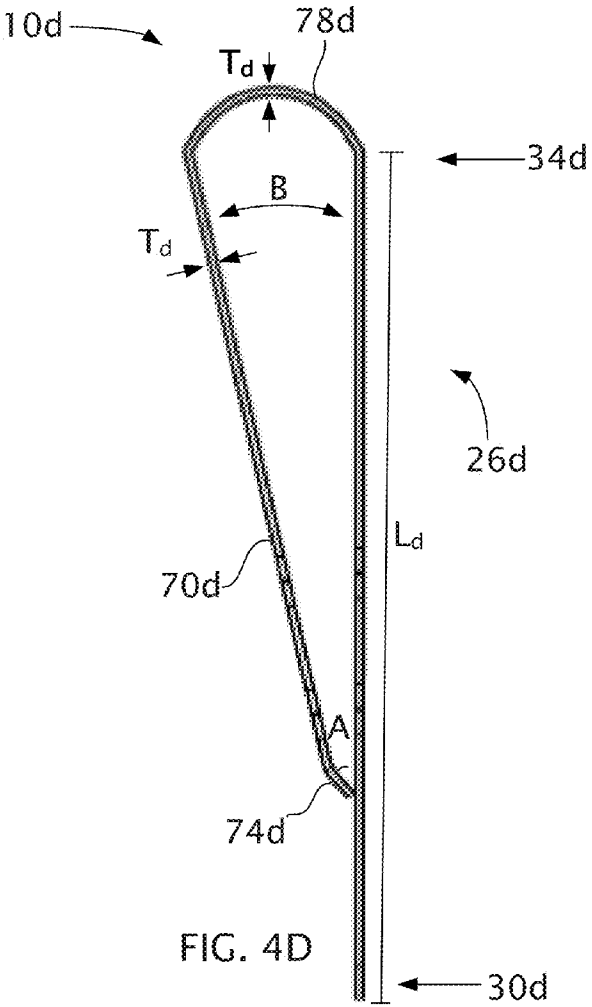
FIG. 4C-4D depict side views of the money holding device depicted in FIG. 4A.
Figure 4C:
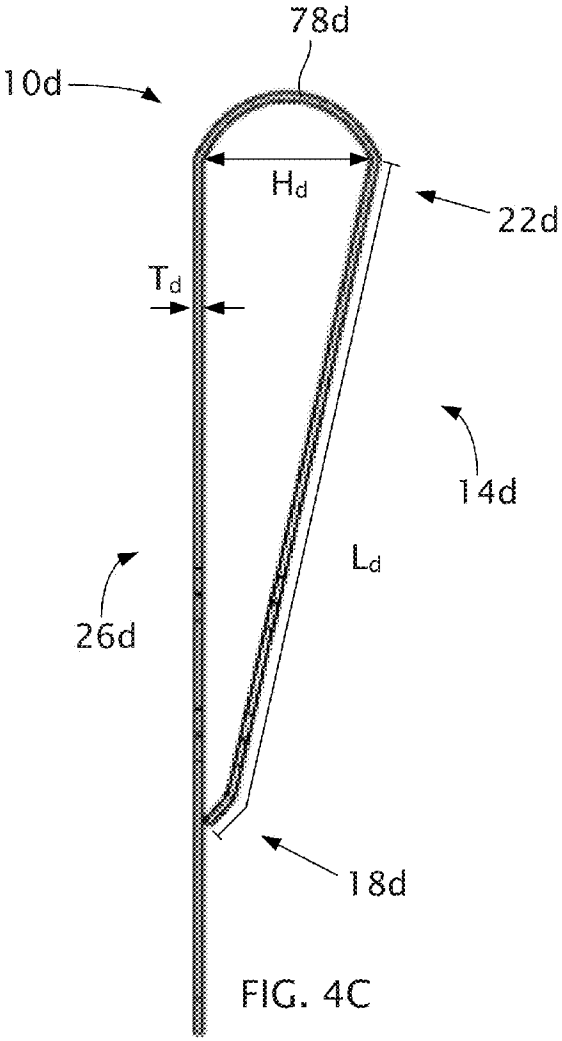
Figure 4F:
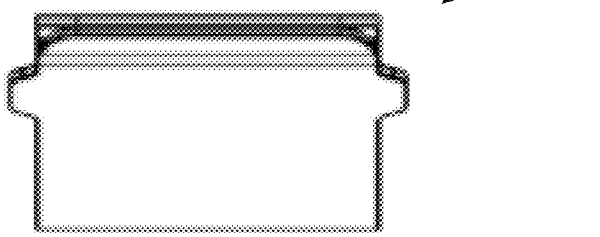
FIG. 4F depicts an upside down front view of the money holding device depicted in FIG. 4A.
Figure 4G:
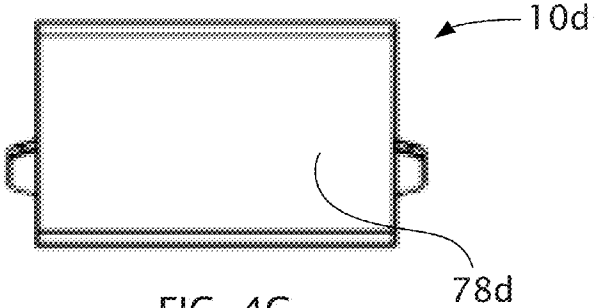
FIG. 4G depicts a back view of the money holding device depicted in FIG. 4A.
Figure 4E:
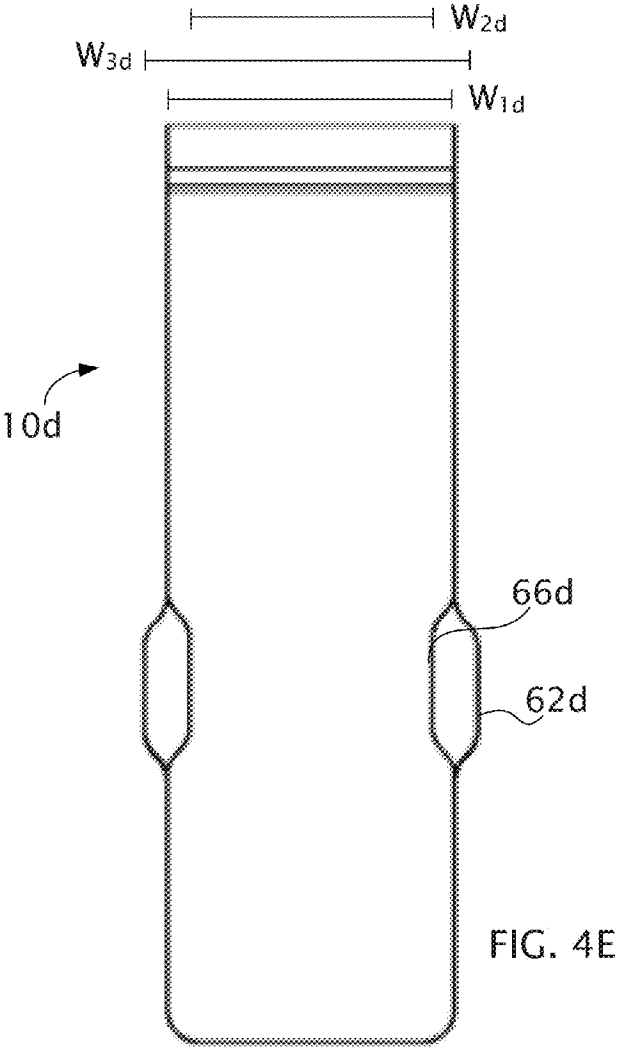
FIG. 4E depicts a bottom view of the money holding device depicted in FIG. 4A.
Figure 5A:
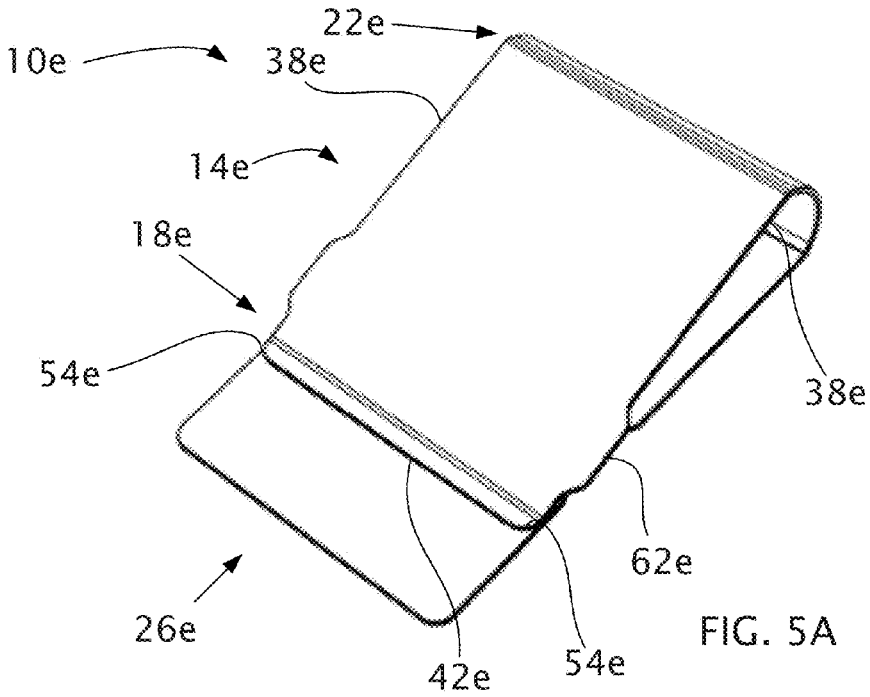
FIG. 5A depicts a top perspective view of another embodiment of the present money holding devices in a closed configuration.
Figure 5B:
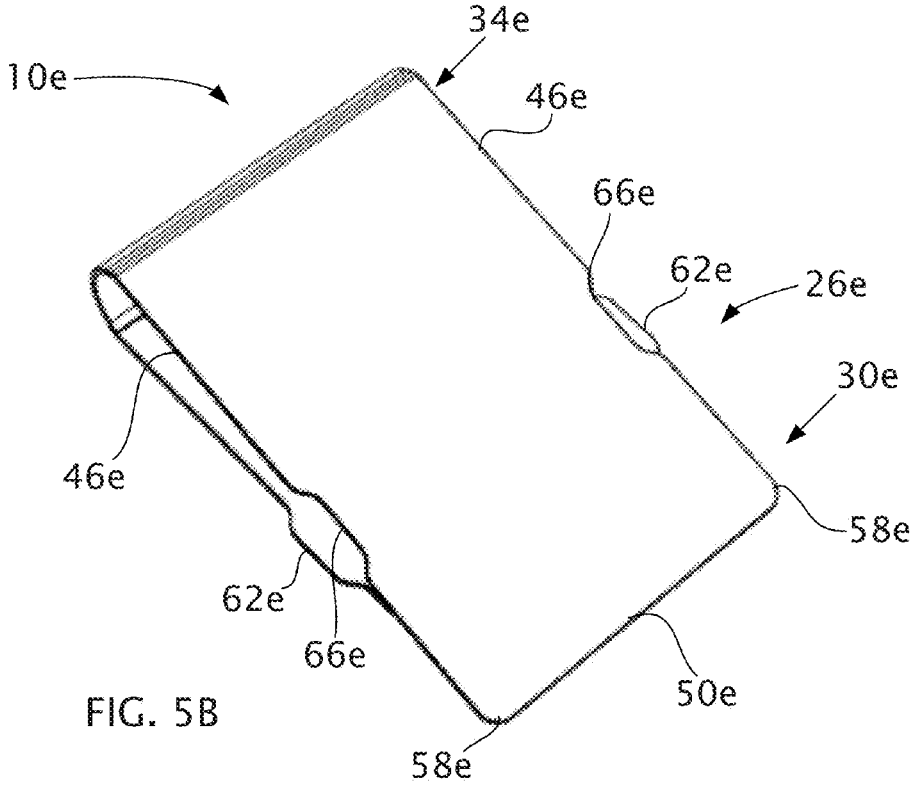
FIG. 5B depicts a bottom perspective view of the money holding device depicted in FIG. 5A.
Figure 5D:
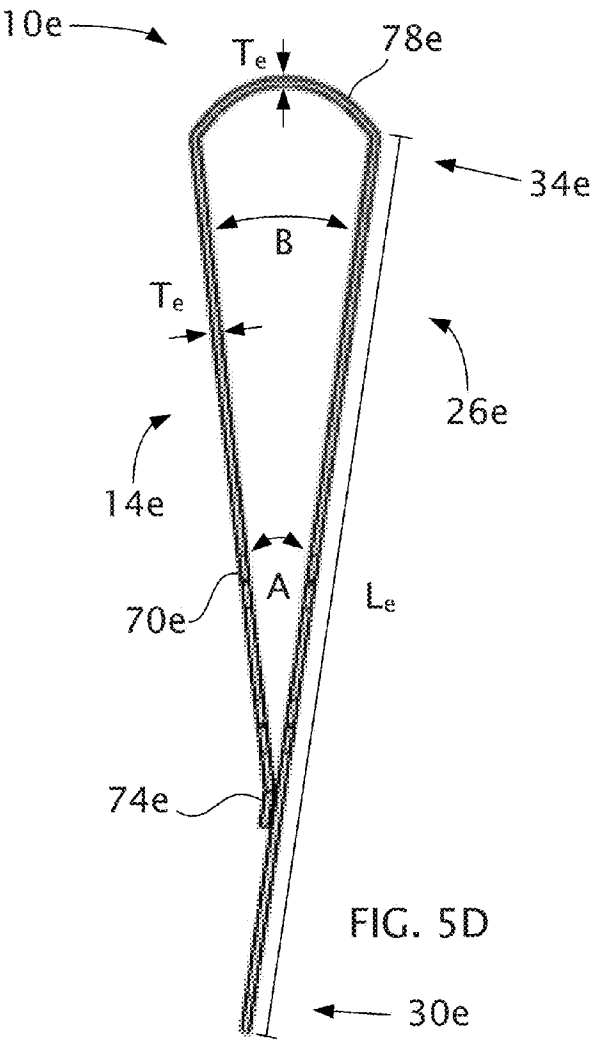
FIG. 5C-5D depict side views of the money holding device depicted in FIG. 5A.
Figure 5C:
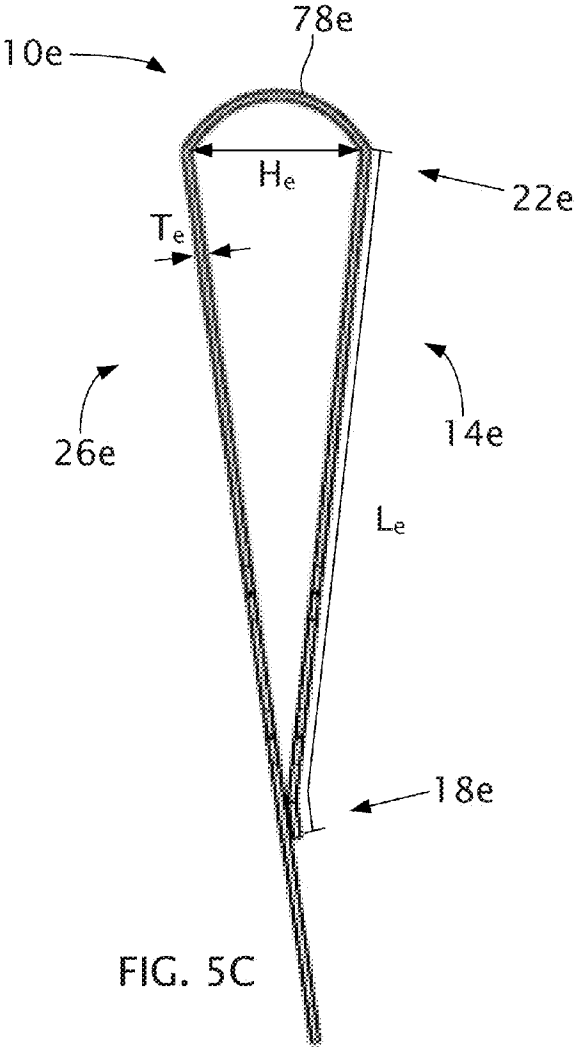
Figure 5F:
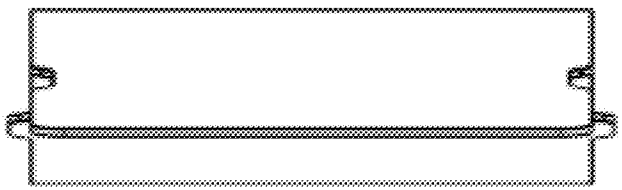
FIG. 5F depicts an upside down front view of the money holding device depicted in FIG. 5A.
Figure 5G:
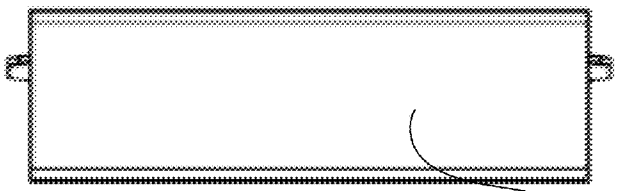
FIG. 5G depicts a back view of the money holding device depicted in FIG. 5A.
Figure 5E:
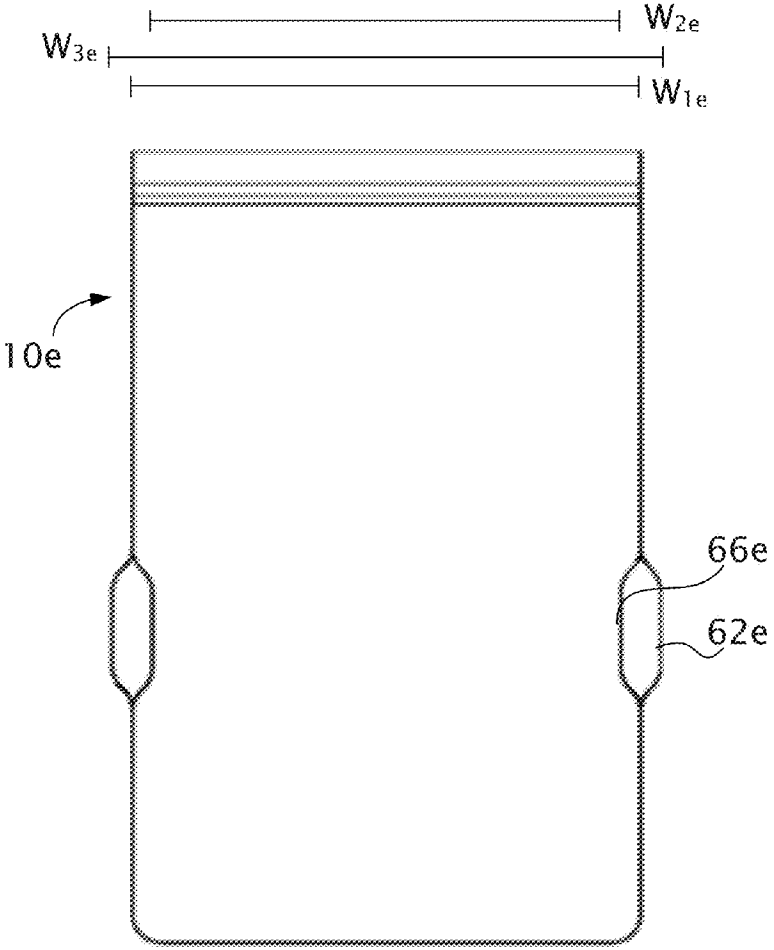
FIG. 5E depicts a bottom view of the money holding device depicted in FIG. 5A.
Figure 6A:
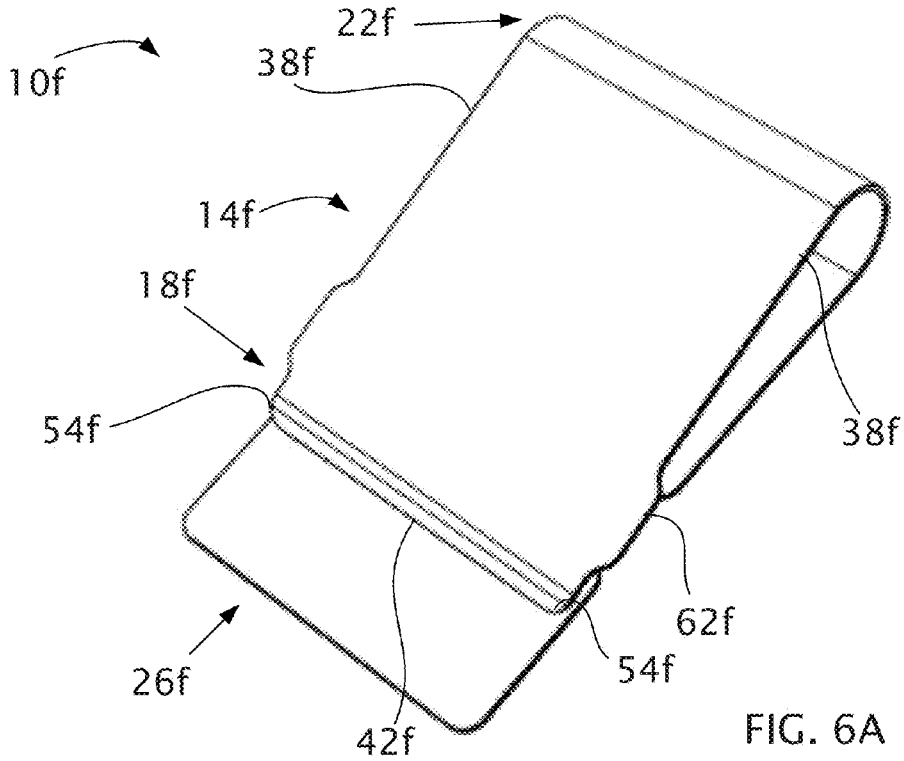
FIG. 6A depicts a top perspective view of another embodiment of the present money holding devices in a closed configuration.
Figure 6B:
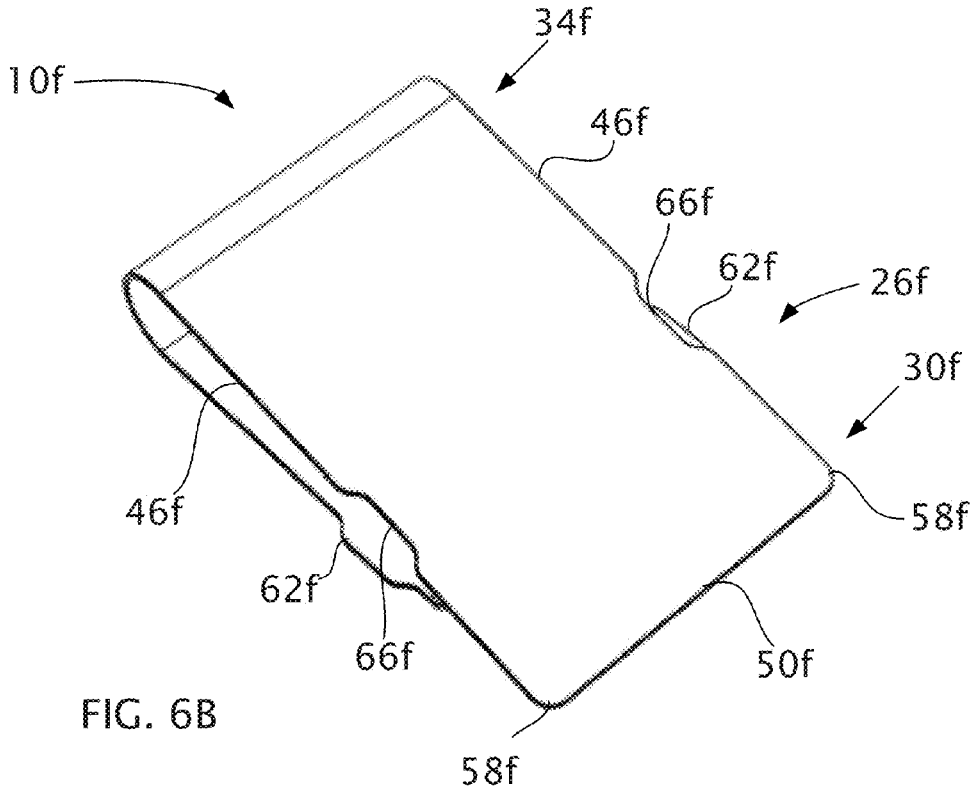
FIG. 6B depicts a bottom perspective view of the money holding device depicted in FIG. 6A.
Figure 6D:
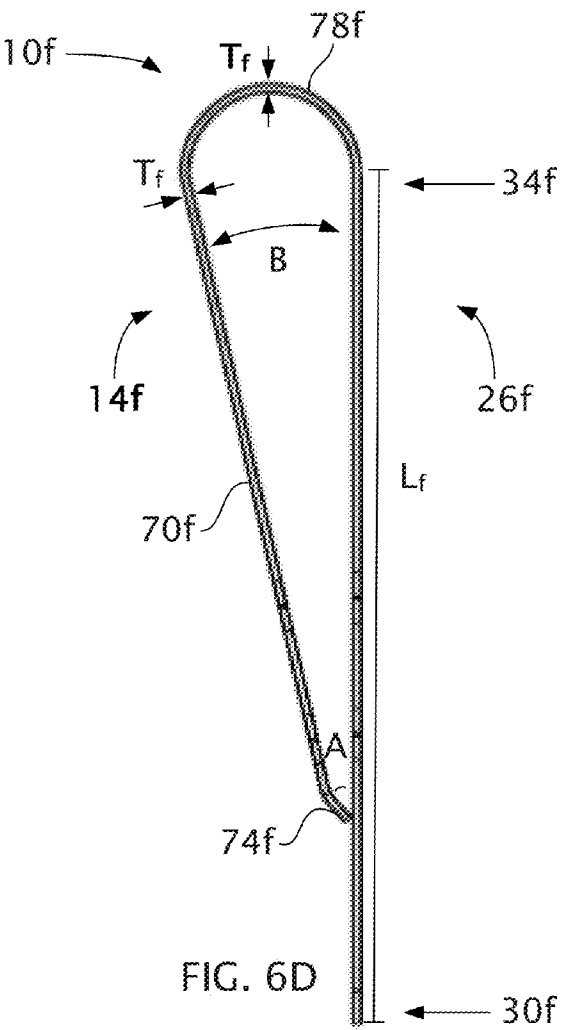
FIG. 6C-6D depict side views of the money holding device depicted in FIG. 6A.
Figure 6C:
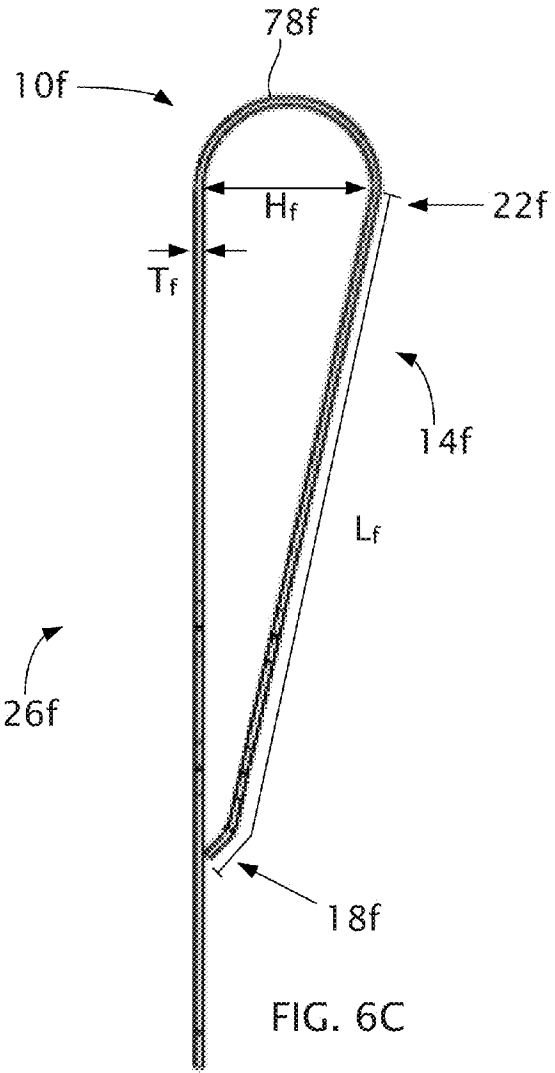
Figure 6F:
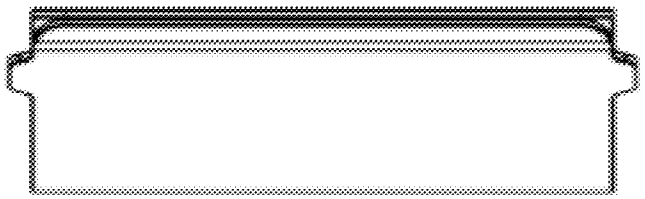
FIG. 6F depicts an upside down front view of the money holding device depicted in FIG. 6A.
Figure 6G:
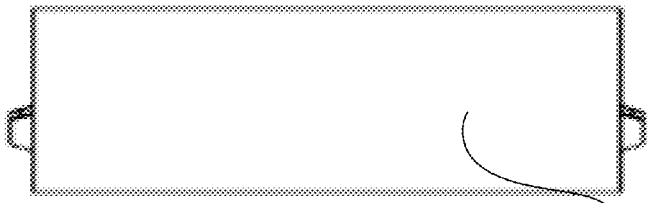
FIG. 6G depicts a back view of the money holding device depicted in FIG. 6A.
Figure 6E:
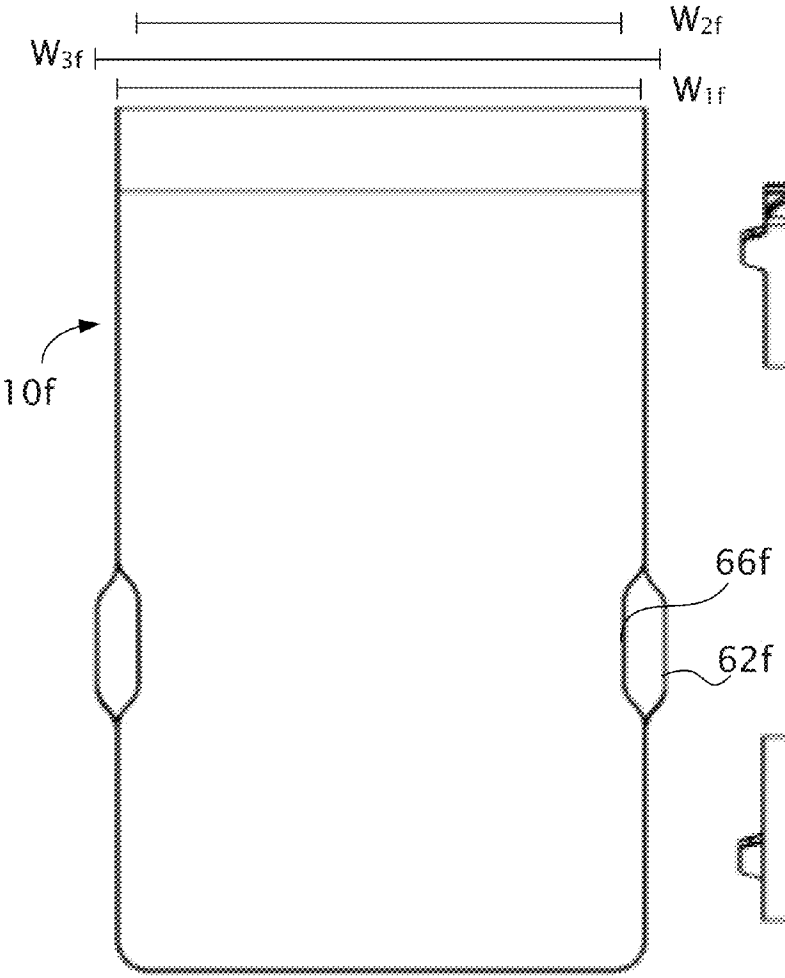
FIG. 6E depicts a bottom view of the money holding device depicted in FIG. 6A.
Figure 7A:
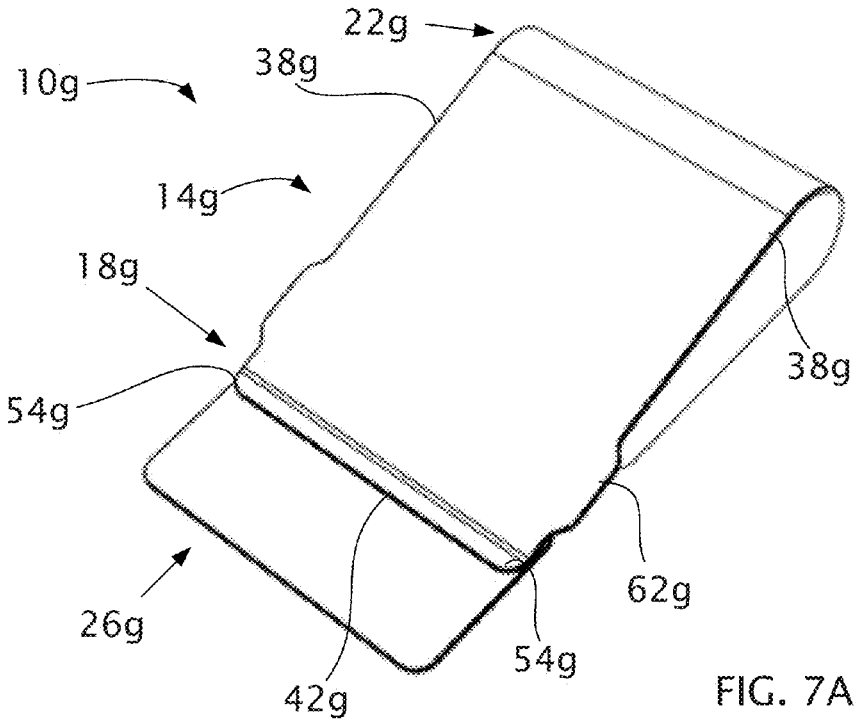
FIG. 7A depicts a top perspective view of another embodiment of the present money holding devices in a closed configuration.
Figure 7B:
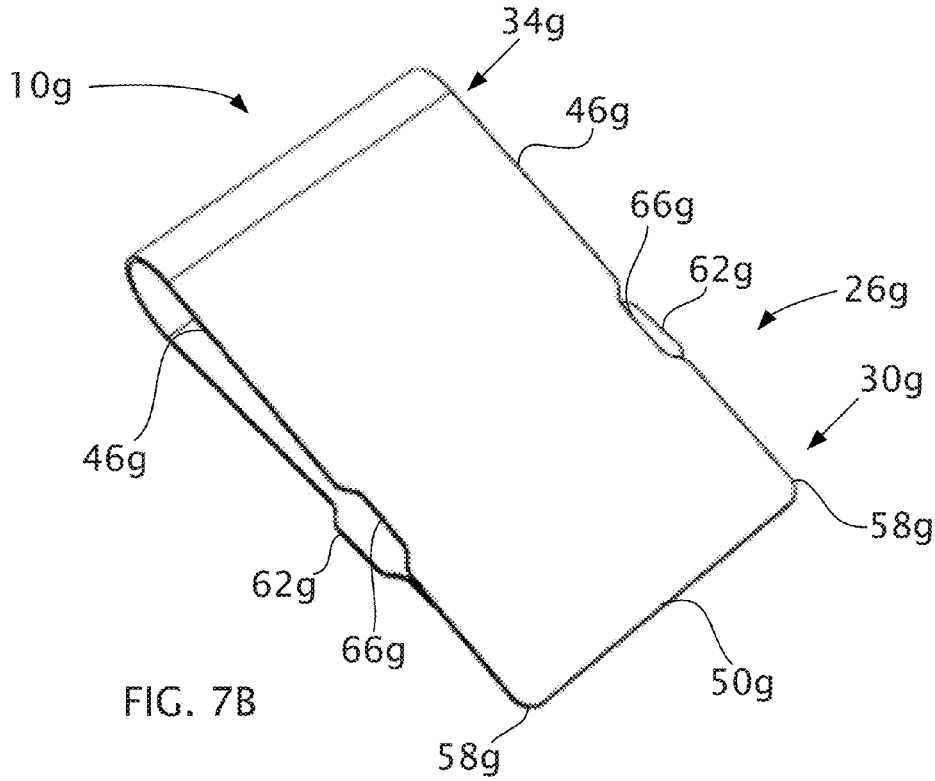
FIG. 7B depicts a bottom perspective view of the money holding device depicted in FIG. 7A.
Figure 7D:
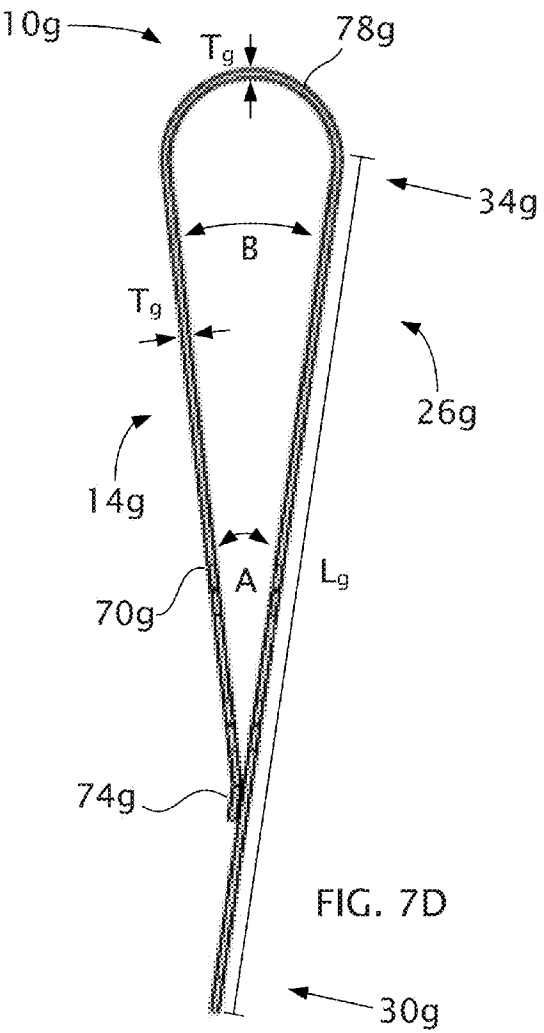
FIG. 7C-7D depict side views of the money holding device depicted in FIG. 7A.
Figure 7C:
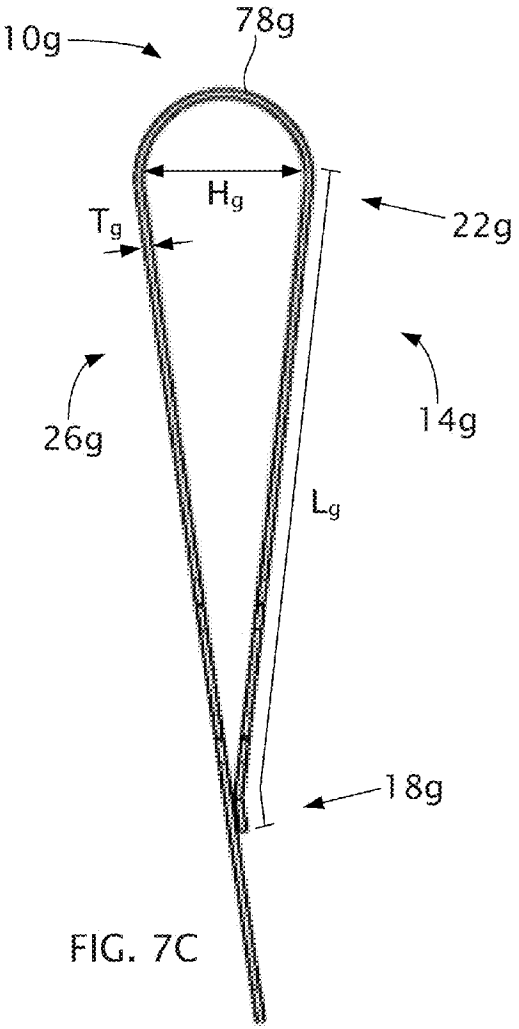
Figure 7F:
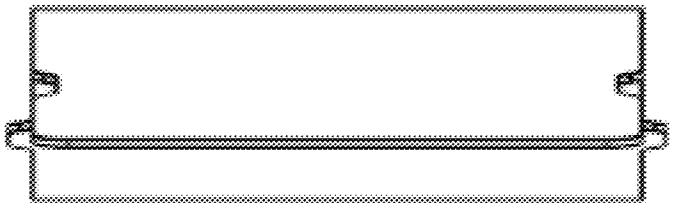
FIG. 7F depicts an upside down front view of the money holding device depicted in FIG. 7A.
Figure 7G:
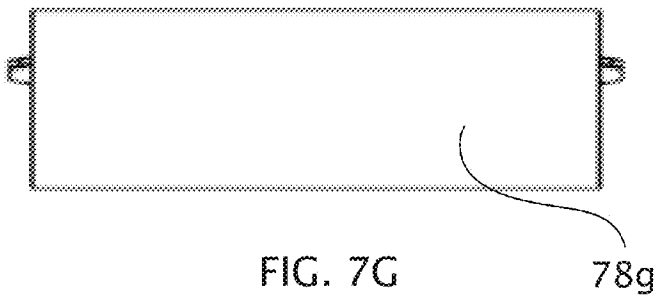
FIG. 7G depicts a back view of the money holding device depicted in FIG. 7A.
Figure 7E:
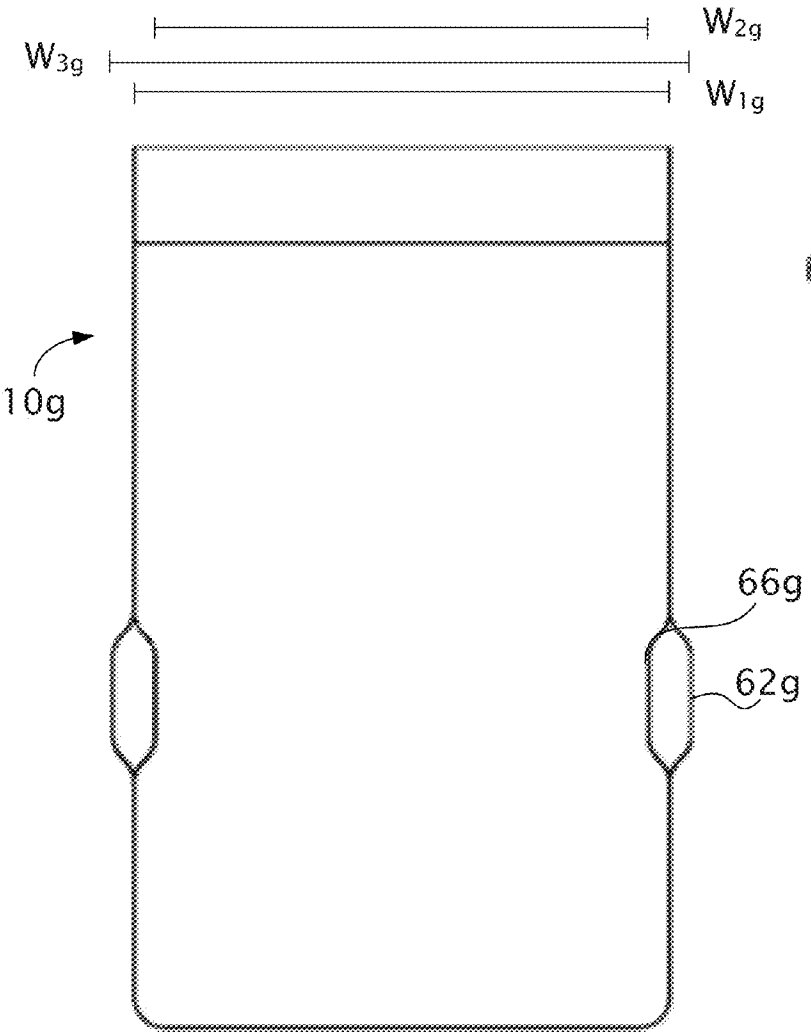
FIG. 7E depicts a bottom view of the money holding device depicted in FIG. 7A.
Figure 7H:
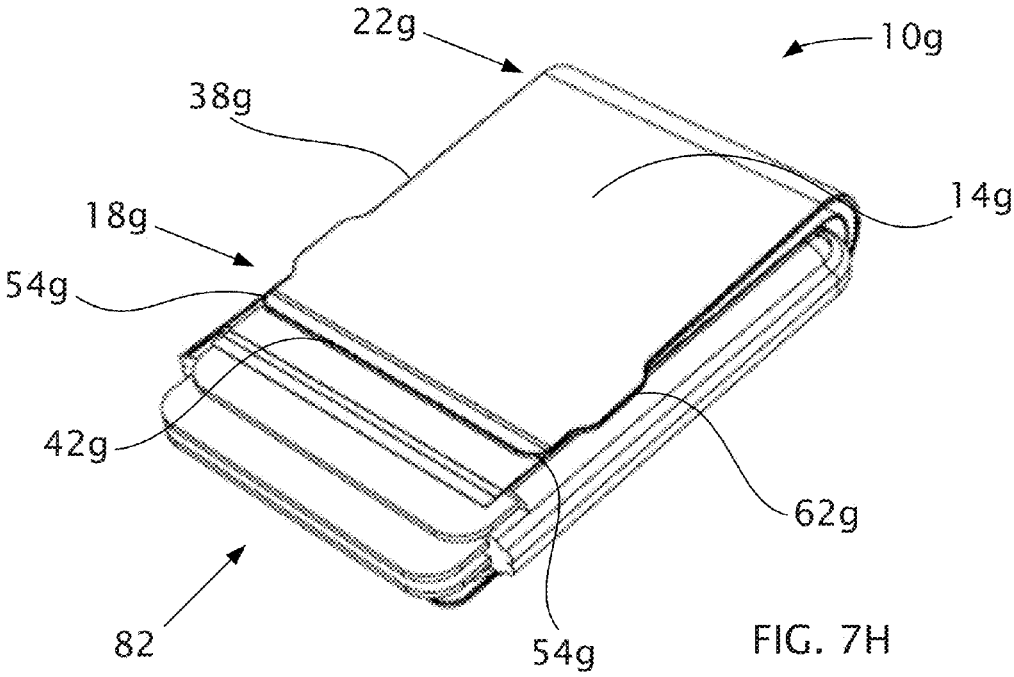
FIG. 7H depicts a top perspective view of the money holding device depicted in FIG. 7A in an open configuration and coupled to a wallet.
Figure 7I:
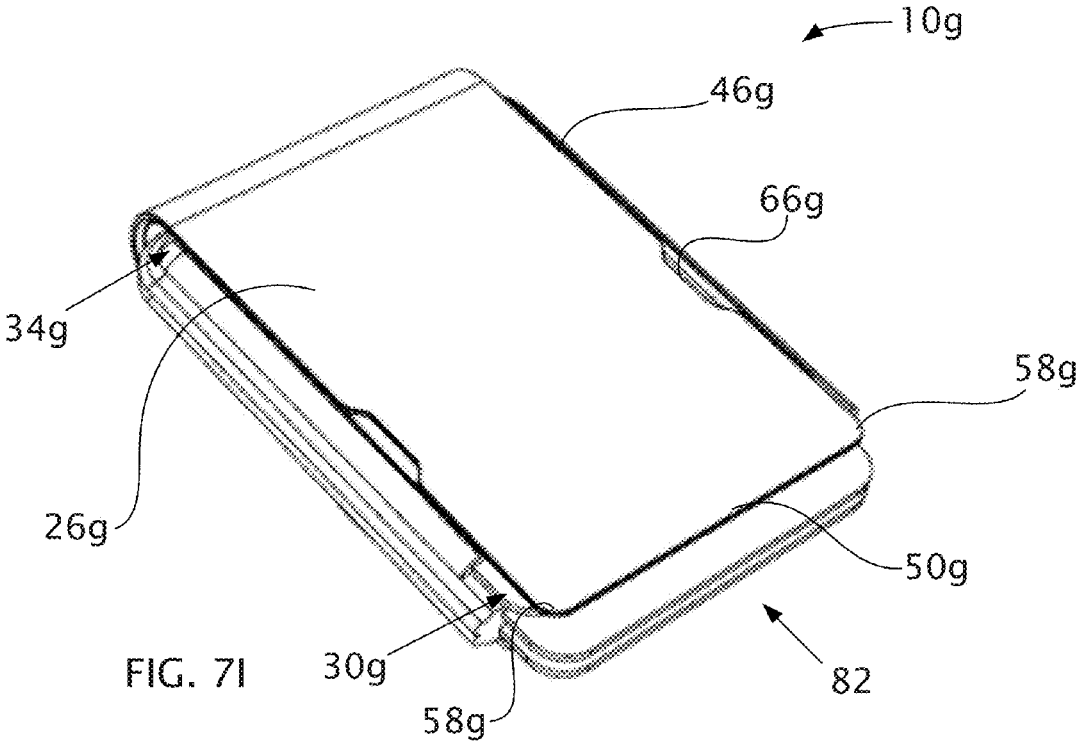
FIG. 7I depicts a bottom perspective view of the money holding device depicted in FIG. 7A in an open configuration and coupled to a wallet.

Referring now to FIGS. 1A-7I, represented by numerals 10*a*-10*g* are embodiments of the present money holding devices (referred to collectively as money holding devices 10). In the embodiments shown, money holding devices 10 comprise first members 14*a*-14*g* (referred to collectively as first members 14). First members 14 have first ends 18*a*-18*g* (referred to collectively as first ends 18) and second ends 22*a*-22*g* (referred to collectively as second ends 22). First members 14 comprise lengths $L_a$- $L_g$ (referred to collectively as lengths L) extending from first ends 18 to second ends 22. In the embodiments shown in FIGS. 1A-2G, for example, lengths $L_a$ and $L_b$ of first members 14*a* and 14*b*, respectively, are approximately 50 to 55 millimeters. In some embodiments, lengths $L_a$ and $L_b$ of first members 14*a* and 14*b*, respectively, can be approximately 45 to 60 millimeters. In the embodiments shown in FIGS. 3A-4G, lengths $L_c$ and $L_d$ of first members 14*c* and 14*d*, respectively, are approximately 60 to 65 millimeters. In some embodiments, lengths $L_c$ and $L_d$ of first members 14*c* and 14*d*, respectively, can be approximately 55 to 70 millimeters. In the embodiments shown in FIGS. 5A-7I, lengths $L_e$,-$L_g$ of first members 14*e*-14*g*, respectively, are 55 to 60 millimeters. In some embodiments, lengths $L_e$-$L_g$ of first members 14*e*-14*g*, respectively, can be approximately 50 to 75 millimeters.

In the embodiments shown, first members 14 further comprise widths $W_{1a}$-$W_{1g}$ (referred to collectively as widths $W_1$). Widths $W_1$ of first members 14 can be measured substantially perpendicular to lengths L of first members 14. In the embodiments shown in FIGS. 1A-4G, widths $W_{1a}$-$W_{1d}$ of first members 14*a*-14*d*, respectively, are approximately 23 to 27 millimeters. In some embodiments, widths $W_{1a}$-$W_{1d}$ of first members 14*a*-14*d*, respectively, can be approximately 20 to 30 millimeters. In the embodiments shown in FIGS. 5A-7I, widths $W_{1e}$-$W_{1g}$ of first members 14*e*-14*g*, respectively, are approximately 48 to 52 millimeters. In some embodiments, widths $W_{1e}$-$W_{1g}$ of first members 14*e*-14*g*, respectively, can be 45 to 55 millimeters.

In the embodiments shown, first members 14 comprise thicknesses $T_a$-$T_g$ (referred to collectively as thicknesses T). In the embodiments shown, thicknesses T of first members 14 are approximately 0.5 to 1.5 millimeters. In some embodiments, thicknesses T of first members 14 can be approximately 0.3 to 2 millimeters.

In the embodiments shown, money holding devices 10 further comprise second members 26*a*-26*g* (referred to collectively as second members 26). Second members 26 comprise first ends 30*a*-30*g* (referred to collectively as first ends 30) and second ends 34*a*-34*g* (referred to collectively as second ends 34). Second members 26 comprise lengths $L_a$-$L_g$ (referred to collectively as lengths L) extending from first ends 30 to second ends 34. In the embodiments shown in FIGS. 1A-2G, for example, lengths $L_a$ and $L_b$ of second members 26*a* and 26*b*, respectively, are approximately 68 to 72 millimeters. In some embodiments, lengths $L_a$ and $L_b$ of second members 26*a* and 26*b*, respectively, can be approximately 65 to 80 millimeters. In the embodiments shown in FIGS. 3A-4G, lengths $L_c$ and $L_d$ of second members 26*c* and 26*d*, respectively, are approximately 78 to 82 millimeters. In some embodiments, lengths $L_c$ and $L_d$ of second members 26*c* and 26*d*, respectively, can be approximately 75 to 90 millimeters. In the embodiments shown in FIGS. 5A-7I, lengths $L_e$,-$L_g$ of second members 26*e*-26*g*, respectively, are approximately 72 to 76 millimeters. In some embodiments, lengths $L_e$-$L_g$ of second members 26*e*-26*g*, respectively, can be approximately 70 to 85 millimeters.

In the embodiments shown, lengths L of second members 26 can be greater than lengths L of first members 14. For example, in some embodiments, lengths L of first members 14 can be approximately 70 to 80 percent of lengths L of second members 26 (e.g., FIGS. 1A-3I). In other embodiments, lengths L of first members 14 can be approximately 75 to 85 percent of lengths L of second members 26 (e.g., FIGS. 4A-7I).

In the embodiments shown, second members 26 can be configured such that first ends 30 of second members 26 can extend beyond first ends 18 of first members 14. For example, first ends 30 of second members 26 can extend approximately 15 to 19 millimeters beyond first ends 18 of first members 14. In some embodiments, first ends 30 of second members 26 can extend approximately 10 to 25 millimeters beyond first ends 18 of first members 14. A length that first ends 30 of second members 26 extends beyond first ends 18 of first members 14, if any, can also be expressed in terms of percentages. For example, in some embodiments, 20 to 30 percent of lengths L of second members 26 can extend beyond first ends 18 of first members 14 (e.g., FIGS. 1A-3I). In other embodiments, 15 to 25 percent of lengths L of second members 26 can extend beyond first ends 18 of first members 14 (e.g., FIGS. 4A-7I).

In the embodiments shown, second members 26 further comprise widths $W_{1a}$-$W_{1g}$ (referred to collectively as widths $W_1$). Widths $W_1$ of second members 26 can correspond to widths $W_1$ of first members 14 (e.g., and are so labeled in FIGS. 1A-7I). Widths $W_1$ of second members 26 can be measured substantially perpendicular to lengths L of second members 26. In the embodiments shown in FIGS. 1A-4G, widths $W_{1a}$-$W_{1d}$ of second members 26*a*-26*d*, respectively, are approximately 23 to 27 millimeters. In some embodiments, widths $W_{1a}$-$W_{1d}$ of second members 26*a*-26*d*, respectively, can be approximately 20 to 30 millimeters. In the embodiments shown in FIGS. 5A-7I, widths $W_{1e}$-$W_{1g}$ of second members 26*e*-26*g*, respectively, are approximately 48 to 52 millimeters. In some embodiments, widths $W_{1e}$-$W_{1g}$ of second members 26*e*-26*g*, respectively, can be 45 to 55 millimeters. In other embodiments, width $W_1$ of second members 26 is less than a width of first members 14 (e.g., less than width $W_1$ of first members 14). Similarly, in other embodiments, width $W_1$ of first members 14 is greater than a width of second members 26 (e.g., greater than width $W_1$ of second members 26).

In the embodiments shown, second members 26 can comprise thicknesses $T_a$-$T_g$ (referred to collectively as thicknesses T). In the embodiments shown, thicknesses T of second members 26 are approximately 0.5 to 1.5 millimeters. In some embodiments, thicknesses T of second members 26 can be approximately 0.3 to 2 millimeters. Thicknesses T of second members 26 can correspond—but are not required to correspond—to thicknesses T of first members 14.

In the embodiments shown, first members 14 and second members 26 can comprise more than one (e.g., two, three, four, five, or more) widths (e.g., along the length of the respective member). In some embodiments, second members 26 can be configured such that at least a portion of second members 26 has a width less than at least one width of first members 14 (e.g., less than width $W_1$ of first members 14). For example, second members 26 can comprise widths $W_1$ (e.g., which can correspond to width $W_1$ of first members 14, as discussed above) and further comprise widths $W_{2a}$-$W_{2g}$ (referred to collectively as second widths $W_2$). In the embodiments shown, second members 26 can comprise widths $W_1$ for a majority of lengths L of second members 26 (e.g., as depicted in FIGS. 1A-7I). Second members 26 can comprise widths $W_2$ for approximately 10 to 20 millimeters of lengths L of second members 26 (e.g., as depicted in FIGS. 1A-7I). In the embodiments shown in FIGS. 1A-5G, widths $W_2$ of second members 26 can comprise approximately 15 to 25 millimeters (e.g., when widths $W_1$ of second members 26 comprise approximately 20 to 30 millimeters). In the embodiments shown in FIGS. 5A-7I, widths $W_2$ of second members 26 can comprise approximately 40 to 50 millimeters (e.g., when widths $W_1$ of second members 26 comprise approximately 45 to 55 millimeters).

The difference in widths $W_1$ and $W_2$ of second members 26 can also be expressed in terms of percentages. For example, in some embodiments, widths $W_2$ of second members 26 can comprise approximately 80 to 90 percent of widths $W_1$ of second members 26 (e.g., FIGS. 1A-4G). In other embodiments, widths $W_2$ of second members 26 can be approximately 85 to 95 percent of widths $W_1$ of second members 26 (e.g., FIGS. 5A-7I).

As shown in the depicted embodiments, first members 14 can be configured such that at least a portion of first members 14 has a width greater than at least one width of second members 26 (e.g., greater than widths $W_1$ of second members 14). For example, first members 14 can comprise widths $W_1$ (e.g., which can correspond to widths $W_1$ of second members 26, as discussed above) and further comprise widths $W_{3a}$-$W_{3g}$ (referred to collectively as second widths $W_3$). As shown in the depicted embodiments, first members 14 can comprise widths $W_1$ for a majority of lengths L of first members 14 (e.g., as depicted in FIGS. 1A-7I). First members 14 can comprise widths $W_3$ for approximately 10 to 20 millimeters of lengths L of first members 14 (e.g., as depicted in FIGS. 1A-7I). In the embodiments shown in FIGS. 1A-5G, widths $W_3$ of first members 14 can be approximately 25 to 35 millimeters (e.g., when widths $W_1$ of first members 14 comprise approximately 20 to 30 millimeters). In the embodiments shown in FIGS. 5A-7I, widths $W_3$ of first members 14 can comprise approximately 50 to 60 millimeters (e.g., when widths $W_1$ of first members 14 comprise approximately 45 to 55 millimeters).

The difference in widths $W_1$ and $W_3$ of first members 14 can also be expressed in terms of percentages. For example, in some embodiments, widths $W_3$ of first members 14 can comprise approximately 110 to 120 percent of widths $W_1$ of first members 14 (e.g., FIGS. 1A-4G). In other embodiments, widths $W_3$ of first members 14 can comprise approximately 105 to 115 percent of widths $W_1$ of first members 14 (e.g., FIGS. 5A-7I).

In the embodiments shown, first members 14 can be configured such that at least a portion of first members 14 has at least one width (e.g., widths $W_3$) greater than at least one width of second members 26 (e.g., greater than widths $W_1$ of second members 14) and second members 26 can be configured such that at least a portion of second members 26 has at least one width (e.g., widths $W_2$) less than at least one width of first members 14 (e.g., less than widths $W_1$ of first members 14). For example, in some embodiments, widths $W_1$ of first members 14 can comprise approximately 20 to 30 millimeters and widths $W_3$ of first members 14 can comprise approximately 25 to 35 millimeters. In some embodiments, widths $W_1$ of first members 14 can comprise approximately 45 to 55 millimeters and widths $W_3$ of first members 14 can comprise approximately 50 to 60 millimeters. In some embodiments, widths $W_1$ of second members 26 can comprise approximately 20 to 30 millimeters and widths $W_2$ of second members 26 can comprise approximately 15 to 25 millimeters. In some embodiments, widths $W_1$ of second members 26 can comprise approximately 45 to 55 millimeters and widths $W_2$ of second members 26 can comprise approximately 40 to 50 millimeters. In the embodiment shown, widths $W_1$ of first members 14 substantially correspond to widths $W_1$ of second members 26. Further, in the embodiment shown, the portions of first members 14 that comprise widths $W_3$ substantially correspond to the portions of second members 26 that comprise widths $W_2$.

In the embodiments shown, first members 14 and second members 26 can be substantially rectangular in shape and can also be substantially planar. First members 14 can comprise longitudinal edges 38*a*-38*g* (referred to collectively as longitudinal edges 38) that define a width (e.g., widths $W_1$, widths $W_3$, etc.). In the embodiments shown, longitudinal edges 38 are parallel. Further, first members 14 can comprise lateral edges 42*a*-42*g* (referred to collectively as lateral edges 42) that define a length of first members 14 (e.g., lengths L of first members 14). In the embodiments shown, lateral edges 42 are parallel. In the embodiments shown, longitudinal edges 38 of first members 14 can correspond in length to lengths L of first members 14 and lateral edges 42 of first members 14 can correspond in length to at least one width of first members 14 (e.g., widths $W_1$, widths $W_2$, etc.). Similarly, in the embodiments shown, second members 26 can comprise longitudinal edges 46*a*-46*g* (referred to collectively as longitudinal edges 46) that define a width (e.g., widths $W_1$, widths $W_2$, etc.). In the embodiment shown, longitudinal edges 46 are parallel. Further, second members 26 can comprise lateral edges 50*a*-50*g* (referred to collectively as lateral edges 50) that define a length of second members 26 (e.g., lengths L of second members 26). In the embodiment shown, lateral edges 50 are parallel. In the embodiments shown, longitudinal edges 46 of second members 26 can correspond in length to lengths L of second members 26 and lateral edges 50 of second members 26 can correspond in length to at least one width of second members 26 (e.g., widths $W_1$, widths $W_2$, etc.).

In the embodiments shown, longitudinal edges 38 and lateral edges 42 of first members 14 can meet at first ends 18 of first members 14 to define corners 54. Similarly, longitudinal edges 46 and lateral edges 50 of second members 26 can meet at first ends 30 of second members 26 to define corners 58. In the embodiment shown, corners 54 and 58 are substantially arcuate. In other embodiments, corners 54 and 58 can define a point and/or any other configuration in order to join longitudinal edges 38 and 46 to lateral edges 42 and 50, respectively.

In the embodiments shown, at least one of longitudinal edges 38 of first members 14 can be configured to define substantially trapezoidal portions 62*a*-62*g* (referred to collectively as substantially trapezoidal portions 62). Substantially trapezoidal portions 62 can correspond to the portion of first members 14 that comprises a width (e.g., widths $W_3$) greater than at least one of the widths of second members 26 (e.g., widths $W_1$, widths $W_2$, etc.). In other embodiments, longitudinal edges 38 of first members 14 can be configured to define various other shapes (e.g., square, arcuate, rhomboidal, etc.) that correspond to the portions of first members 14 that comprise a width (e.g., widths $W_3$) greater than at least one of the widths of second members 26 (e.g., widths $W_1$, widths $W_2$, etc.). In other embodiments, longitudinal edges 38 can be non-parallel (e.g., such that at least a portion of first members 14 comprises a greater width than at least a portion of second members 26).

Similarly, in the embodiments shown, at least one of longitudinal edges 46 of second members 26 can be configured to define substantially trapezoidal portions 66*a*-66*g* (referred to collectively as substantially trapezoidal portions 66). Substantially trapezoidal portions 66 can correspond to the portions of second members 26 that comprise a width (e.g., widths $W_2$) less than at least one of the widths of first members 14 (e.g., widths $W_1$, widths $W_3$, etc.). In other embodiments, longitudinal edges 46 of second members 26 can be configured to define various other shapes (e.g., square, arcuate, rhomboidal, etc.) that correspond to the portions of second members 26 that comprise a width (e.g., widths $W_2$) less than at least one of the widths of first members 14 (e.g., widths $W_1$, widths $W_3$, etc.). In other embodiments, longitudinal edges 46 can be non-parallel (e.g., such that at least a portion of second members 26 comprises a lesser width than at least a portion of first members 14). In the embodiments shown, the length of substantially trapezoidal portions 62 and 66 can comprise a length of approximately 5 to 20 millimeters.

In the embodiments shown, first ends 18 of first members 14 can extend toward a surface of second members 26 when devices 10 are in a closed configuration. In some embodiments, first ends 18 of first members 14 can contact a surface of second members 26; and in other embodiments, first ends 18 of first members 14 can terminate prior to contacting a surface of second members 26. In the embodiments shown, a surface of second members 26 and a surface of first members 14 can define an angle A. In some embodiments, first members 14 can comprise one portion (e.g., a substantially planar portion). In the embodiments shown, first members 14 can comprise first portions 70*a*-70*g* (referred to collectively as first portions 70) and second portions 74*a*-74*g* (referred to collectively as second portions 74). In some embodiments, second portions 74 of first members 14 can extend parallel to a surface of second members 26 (e.g., second portions 74*a*, 74*c*, 74*e*, and 74*g* of FIGS. 1A-1I, 3A-3I, 5A-5G, and 7A-7I). In some embodiments, second portions 74 can join first portions 70 at an angle (e.g., 40, 45, 50, 55 degrees, etc.) such that second portions 74 of first members 14 can be disposed toward a surface of second members 26 (e.g., as depicted in FIGS. 2A-2G, 4A-4G, and 6A-6G). In the embodiments shown in FIGS. 2A-2G, 4A-4G, and 6A-6G, angle A (e.g., defined by second portions 74 of first members 14 and a surface of second members 26) can be different from an angle at which second portions 74 join first portions 70. For example, second portions 74 of first members 14 can comprise a length of approximately 1 to 5 millimeters. As another example, second portions 74 of first members 14 can comprise approximately 1 to 10 percent of the length of first portions 70 of first members 14.

In the embodiments shown, money holding devices 10 can further comprise connectors 78*a*-78*g* (referred to collectively as connectors 78). Connectors 78 can be resilient (e.g., capable of substantially returning to an original configuration). In the embodiments shown, connectors 78 can be coupled to second ends 22 and 34 of first and second members 14 and 26, respectively. In the embodiments shown, connectors 78 are integrally coupled (e.g., formed from a single piece of material) to second ends 22 and 34 of first and second members 14 and 26, respectively. In the embodiments shown, connectors 78 can be configured to bias at least one of first and second members 14 and 26 toward the other of first and second members 14 and 26 to define a closed configuration. For example, in some embodiments, connectors 78 can be configured to bias first members 14 toward second members 26 (e.g., as depicted in FIGS. 2A-2G, 4A-4G, and 6A-6G). In other embodiments, connectors 78 can be configured to bias second members 26 toward first members 14. In other embodiments, connectors 78 can be configured to bias first members 14 toward second members 26 and second members 26 toward first members 14 (e.g., as depicted in FIGS. 1A-1I, 3A-3I, 5A-5G, and 7A-7I). The language "configured to bias" in this disclosure when used to describe a function of connectors 78 means that the connectors 78 play some role in, though are not necessarily the only structures or features of devices 10 responsible for, biasing at least one of first and second members 14 and 26 toward the other of first and second members 14 and 26 to define a closed configuration. Instead, in at least some embodiments, the material used for the device, including the material of the first and second members of a given device (e.g., and the manner in which that material is linked to the material of the connector), may also help to bias at least one of first and second members 14 and 26 toward the other of first and second members 14 and 26 to define a closed configuration.

In the embodiments shown, connectors 78 couple first and second members 14 and 26 at an angle B (e.g., 10, 15, 20, 25 degrees, etc.). Angle B can correspond—but is not required to correspond—substantially to angle A (e.g., defined by a surface of second members 26 and first ends 18 of first members 14) when money holding devices 10 are in a closed configuration. In the embodiments shown, connectors 78 comprise heights $H_a$-$H_g$ (referred to collectively as heights H) corresponding to a distance between second ends 22 and 34 of first and second members 14 and 26, respectively. For example, heights H of connectors 78 can comprise approximately 10 to 20 millimeters. In the embodiments shown, connectors 78 further comprise thicknesses $T_a$-$T_g$ (referred to collectively as thicknesses T of the connectors). For example, thicknesses T of the connectors can comprise approximately 0.5 millimeters to 1.5 millimeters and/or from approximately 1.5 to 2.5 millimeters. In other embodiments, thicknesses T of the connectors can comprise less than 0.5 millimeters or more than 2.5 millimeters (e.g., depending on amount of bias, weight, etc.). In the embodiments shown, connectors 78 can be substantially arcuate. In other embodiments, connectors 78 can comprise any other configuration (e.g., a planar configuration) configured to bias at least one of first members 14 and second members 26 toward the other of first members 14 and second members 26. In the embodiments shown, connectors 78 can comprise an arc radius of approximately 5 to 10 millimeters.

In the embodiments shown in FIGS. 6A-7I, first and second members 14 and 26 can meet connectors 78 at a zero degree angle (e.g., such that first and second members 14 and 26 are tangent to connectors 78 at the location at which first and second members 14 and 26 meet connectors 78). For example, first and second members 14 and 26 can meet connectors 78 at a location at which a slope of connectors 78 and a slope of first and second members 14 and 26 are substantially the same (e.g., such that first and second members 14 and 26 are flush with connectors 78). In such embodiments, an arc radius of connectors 78 can comprise—but are not required to comprise—from approximately 150 to 190 degrees.

In the embodiments shown in FIGS. 1A-5G, first and second members 14 and 26 can also meet connectors 78 at a non-zero degree angle (e.g., such that first and second members 14 and 26 are non-tangent to connectors 78 at the location at which first and second members 14 and 26 join connectors 78). For example, first and second members 14 and 26 can meet connectors 78 at a location at which a slope of connectors 78 is different from a slope of first and second members 14 and 26 (e.g., such that first and second members 14 and 26 are not flush with connectors 78). In such embodiments, the arc radii of connectors 78 can comprise—but are not required to comprise—approximately 90 to 130 degrees.

In the embodiments shown, a force required to move devices 10 into an open configuration can be greater when at least one of first and second members 14 and 26 meet connectors 78 at a non-zero angle than when first and second members 14 and 26 meet connectors 78 at a zero angle. Further, a force required to move devices 10 into an open configuration can increase as a non-zero degree angle increases (e.g., and/or as an arc radius of connectors 78 decreases from 180 degrees to 1 degree).

In the embodiments shown, first members 14, second members 26, and connectors 78 can comprise various materials. As discussed above, first members 14, second members 26, and/or connectors 78 can comprise a resilient material. Further, first members 14, second members 26, and/or connectors 78 can comprise a polymeric material, a metal, a plastic, etc. For example, first members 14, second members 26, and/or connectors 78 can comprise carbon, carbon steel, carbon fiber, steel, stainless steel, aluminum, and/or plastic.

For example, money holding devices 10 can comprise carbon fiber and/or be reinforced by carbon fiber (e.g., polyacrylonitrile, rayon, petroleum pitch, and/or the like, and combinations thereof). Devices 10 can be manufactured using various production techniques. In some embodiments, money holding devices 10 can be manufactured by layer molding (e.g., layering sheets of carbon fiber into a mold comprising a desired configuration of money holding devices 10). Money holding devices 10 can also be hardened (e.g., with an epoxy, a resin, etc.), heated, and/or air-cured to reach a desired rigidity, resilience, etc. As another example, devices 10 can be manufactured by vacuum molding (e.g., placing carbon fiber in a vacuum mold and applying a hardener (e.g., via a wet layup, a resin reduction system, etc.)). In some embodiments, devices 10 can be manufactured using a dry layup (e.g., such that carbon fiber is already impregnated with a resin). In other embodiments, devices 10 can be compression molded (e.g., disposing carbon fiber and a hardener (e.g., a resin) between a two piece mold comprising a desired configuration of money holding devices 10). Any other suitable method of manufacture can also be used, such as filament winding, pultrusion, weaving, etc.

As another example, devices 10 may be made from carbon steel (e.g., medium carbon steel), or spring steel. To create the device using spring steel, a flat piece that has the shape of the device laid flat may be cut using a die and punch method (e.g., stamped at room temperature). Afterwards, the flat piece of spring steel may be bent to the desired configuration and tempered. The tempering may involve heating the material to 1525 to 1575 degrees F. (Fahrenheit) for a suitable period of time; quenching the material to 350 to 400 degrees F.; and tempering the material to 700 to 800 degrees F. for a suitable period of time. This heating and quenching may result in an Rc50 hardness. Sharp edges may be debugged after the stamping process described above. The debugged material may then be polished using any suitable polishing agent. Furthermore, electroplating and laser engraving may be used as desired. A brass electroplating may be applied to the device, followed by one of a chrome, black nickel and silver electroplating. If chrome electroplating is used, a titanium electroplating may be applied over it. In any case, a clear E coating may be applied over whatever electroplating is carried out.

In the embodiments shown, devices 10 can be configured to be coupled to a wallet, money, paper, cards, etc. (e.g., wallets 82). Devices 10 can be moved into an open configuration from a closed configuration by applying a force to first members 14 at a position corresponding to the portions of first and second members 14 and 26 comprising widths $W_2$ and/or $W_3$ (e.g., and/or any position corresponding to a portion of first members 14 comprising a greater width than a corresponding portion of second members 26 and/or a portion of second members 26 comprising a lesser width than a corresponding portion of first members 14). When devices 10 are coupled to a wallet, money, cards, etc. (e.g., wallets 82), at least one of first and second members 14 and 26 can apply a force (e.g., toward the other of the first and second members 14 and 26) to the wallet, money, cards, etc. Further, when devices 10 are coupled to wallet, money, cards, etc. (e.g., wallets 82), at least one of first ends 18 and 30 of first and second members 14 and 26, respectively, are substantially parallel to the wallet, money, etc. in an open configuration (e.g., such that first ends 18 and 30 of first and second members 14 and 26, respectively, are not disposed away from the wallet, money, etc. (e.g., wallets 82)). Even more specifically, some embodiments of devices 10 are configured such that, in an open configuration (which may also correspond to a configuration that is full of, or loaded with, a wallet filled with several cards and at least some paper money around the wallet) opposing surfaces of the first and second members are substantially flush with (or flat against) the outer-most contents held by the device.

The above specification and examples provide a complete description of the structure and use of exemplary embodiments. Although certain embodiments have been described above with a certain degree of particularity, or with reference to one or more individual embodiments, those skilled in the art could make numerous alterations to the disclosed embodiments without departing from the scope of this invention. For example, various dimensions of devices 10 (e.g., thicknesses T, lengths L, widths $W_1$, $W_2$, and $W_3$, heights H, etc.) are not required to be limited to the recited dimensions and can be configured to be greater or lesser than the recited dimensions (e.g., depending on the size of a wallet, money, etc., configurations of other dimensions of devices 10, desired strength of devices 10, etc.). As such, the various illustrative embodiments of the present devices are not intended to be limited to the particular forms disclosed. Rather, they include all modifications and alternatives falling within the scope of the claims, and embodiments other than the one shown may include some or all of the features of the depicted embodiment. For example, components may be combined as a unitary structure and/or connections may be substituted. Further, where appropriate, aspects of any of the examples described above may be combined with aspects of any of the other examples described to form further examples having comparable or different properties and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A money holding device comprising:

a first member having a first end, a second end, and opposing protrusions across which is at least one width;

a second member having:

a first end extending beyond the first end of the first member;

a second end; and a portion having at least one width that is less than the at least one width of the first member; and a connector coupling the second end of the first member to the second end of the second member, the connector being coupled to the second end of the first member at an interior angle greater than 90 degrees and the connector being coupled to the second end of the second member at an interior angle greater than 90 degrees, the connector configured to bias at least one of the first and second members toward the other of the first and second members to define a closed configuration;

where the device can be moved into an open configuration by applying a force to the opposing protrusions of the first member at a position corresponding to the portion of the second member having at least one width that is less than the at least one width of the first member.

2. The money holding device of claim 1, where the connector is integral with the first member and the second member.

3. The money holding device of claim 2, where the connector is configured to bias the first member toward the second member and the second member toward the first member.

4. The money holding device of claim 2, where the second ends of the first and second members define an angle when the money holding device is in the closed configuration.

5. The money holding device of claim 1, where at least one of the first and second members is tangent to the connector.

6. The money holding device of claim 1, where the first member comprises a first portion and a second portion, and where the second member and the first portion of the first member define an angle at the surface of the second member and the second portion of the first member extends parallel to the surface of the second member.

7. The money holding device of claim 1, where the first member comprises a first portion and a second portion, and where the first and second portions of the first member meet at an angle.

8. The money holding device of claim 7, where the second portion of the first member is disposed toward the second member.

9. A money holding device comprising:

a first member having a first end, a second end, and at least one width;

a second member having:

a first end extending beyond the first end of the first member;

a second end; and a portion having opposing recesses between which is at least one width that is greater than the at least one width of the first member; and a connector coupling the second end of the first member to the second end of the second member, the connector configured to bias at least one of the first and second members toward the other of the first and second members to define a closed configuration;

where the device can be moved into an open configuration by applying a force to the first member at a position corresponding to the portion of the second member having the opposing recesses between which is the at least one width that is less than the at least one width of the first member.

10. The money holding device of claim 9, where the connector is integral with the first member and the second member.

11. The money holding device of claim 10, where the connector is configured to bias the first member toward the second member and the second member toward the first member.

12. The money holding device of claim 10, where the second ends of the first and second members define an angle when the money holding device is in the closed configuration.

13. The money holding device of claim 9, where at least one of the first and second members meets the connector at a location at which the slope of the connector and the slope of the at least one member is substantially the same.

14. The money holding device of claim 9, where the first member comprises a first portion and a second portion, and where the second member and the first portion of the first member define an angle at the surface of the second member and the second portion of the first member extends parallel to the surface of the second member.

15. The money holding device of claim 14, where the first and second portions of the first member meet at an angle.

16. The money holding device of claim 9, where the first member comprises a first portion and a second portion, where the second member and the second portion of the first member define an angle at the surface of the second member, and where an angle at which the first and second portions of the first member meet is different from the angle defined by the second member and the second portion of the first member.

17. A money holding device comprising:

a first member having:

a first end;

a second end;

a first width; and opposing protrusions across which is a second width that is greater than the first width;

a second member having:

a first end extending beyond the first end of the first member;

a second end; and a portion having opposing recesses between which is at least one width that is less than the first width of the first member; and a connector coupling the second end of the first member to the second end of the second member, the connector configured to bias at least one of the first and second members toward the other of the first and second members to define a closed configuration;

where the device can be moved into an open configuration by applying a force to the first member at at least one of the opposing protrusions of the first member and a position corresponding to the portion of the second member with a width of less than the first width of the first member.

18. The money holding device of claim 17, where at least one of the first and second members meets the connector at a location at which the connector and the at least one member are flush.

19. The money holding device of claim 17, where the first member extends to a surface of the second member in the closed configuration.

20. The money holding device of claim 17, where the device is configured such that the first and second members can be positioned parallel to each other and in contact with material held by the device.

* * * * *